US005529550A

United States Patent [19]

Maycock, Jr. et al.

[11] Patent Number: 5,529,550

[45] Date of Patent: Jun. 25, 1996

[54] DEVICE FOR FOREARM, ELBOW, WRIST, HAND, FINGER AND THUMB EXERCISE

[76] Inventors: Sidney M. Maycock, Jr., 490 N. Black Horse Pike, Williamstown, N.J. 08094; Garrison M. Pomeroy, 1415 E. Rte. 70, Suite 502, Cherry Hill, N.J. 08034; Al Gebhard, 2101 E. Alameda, Denver, Colo. 80209

[21] Appl. No.: 390,128

[22] Filed: Feb. 17, 1995

[51] Int. Cl.[6] ..... A63B 5/00

[52] U.S. Cl. ..... 482/44; 482/46; 482/132

[58] Field of Search ..... 482/44, 45, 46, 482/47, 48, 49, 50, 121, 122, 124, 126, 131, 132, 133, 138, 139, 907

[56] References Cited

U.S. PATENT DOCUMENTS 1,497,243 6/1924 Martin ..... 482/146

3,472,508 10/1969 Baker ..... 482/79

4,380,231 4/1983 Roche et al. ..... 482/79

5,135,450 8/1992 Smith ..... 482/80

5,222,925 6/1993 Maycock et al. ..... 482/44

*Primary Examiner*—Stephen R. Crow

*Attorney, Agent, or Firm*—Simpson & Simpson

[57] ABSTRACT

An exercise device which can be used to perform a variety of exercises for strengthening the forearm, elbow, wrist, hand, fingers and thumb. The device is made up of a variety of component parts that can be assembled in various configurations to be used for different exercises. In addition, certain of the parts can be used independently for other exercises.

5 Claims, 25 Drawing Sheets

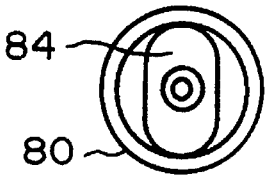
FIG. 7(c)
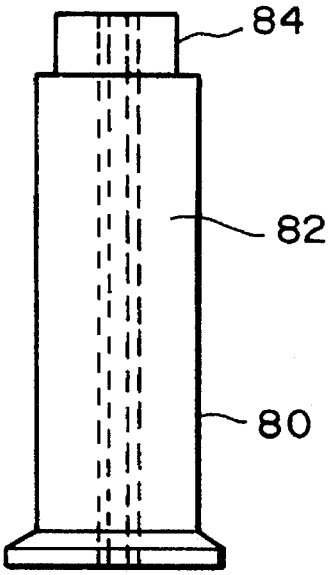
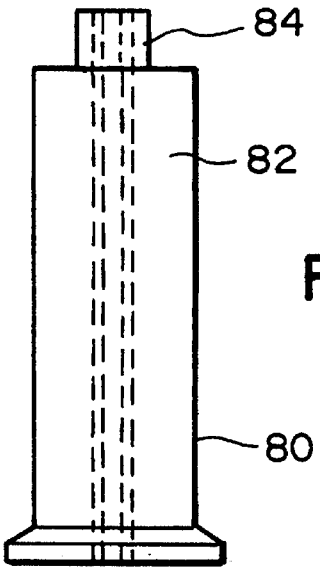
FIG. 7(b)
FIG. 7(a)
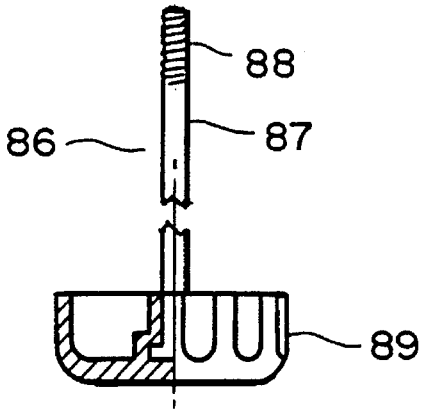
FIG. 8(a)
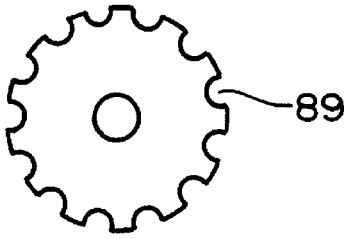
FIG. 8(b)

DEVICE FOR FOREARM, ELBOW, WRIST, HAND, FINGER AND THUMB EXERCISE

BACKGROUND OF THE INVENTION

This invention relates to a device and method of using the device to facilitate the exercise of a person's forearm, elbow, wrist, hand, fingers and thumb. More specifically, the device stretches and strengthens the muscles and tendons of the forearm, elbow, wrist, hand, fingers and thumb.

The incidence of carpal tunnel syndrome is a common malady among persons who repetitively and repeatedly use their wrists and hands, including typists, dental hygienists, piece workers, chiropractors, meat cutters and the like. Carpal tunnel syndrome involves the derangement of the tunnel such that the median nerve is aggravated or possibly injured in contact with the contiguous structure of the wrist. Surgery is not always successful and entails risk. While a variety of treatments have been suggested, including surgery, none of the treatments provide an absolute answer to the problem. Literature now suggests that stretching and strengthening is an important phase of treatment.

Repetitive Motion Trauma (RMT) occurs from continuous or repeated movements of the same part of the body. For example, racket sports such as tennis and racquetball sometimes cause the player to strain a tendon, pull a muscle and generally suffer from various ailments grouped under the title "Tennis Elbow". Manipulation can in many cases improve the positioning of the bones and ligaments to reduce pressure on the median nerve. Physical therapy including ultrasound is sometimes effective in combination with other techniques. Absolute abstinence from using the hand is sometimes prescribed. Stretching and strengthening exercises have been recommended and are effective in treating the syndrome. However, the techniques are difficult to master to achieve the best results.

Fractures can also cause a loss of normal motion in the injured joint. Stretching and strengthening of the injured joint help to facilitate recovery from fractures and similar injuries.

Various devices such as the hand and wrist exercising device of U.S. Pat. No. 4,836,531 to Mikhail Niks have been developed to exercise the wrist through a pronation and supination movement. The exercise device of Touraine, described in U.S. Pat. No. 2,819,081, is another device which exercises the wrist and arm in a rotating movement.

In U.S. Pat. No. 5,222,925, the present inventors disclosed a device that can be used on a desk-top or other convenient surface to exercise and flex the wrist in all six directions of movement. This device provides the user with a simple device that primarily focuses on the strengthening of the wrist. None of the prior art devices, nor any of the described treatments, provide a complete solution for RMT and/or carpal tunnel syndrome, particularly with regard to the forearm, hand, fingers and thumb.

SUMMARY OF THE INVENTION

It is an object of the present invention to provide a device which can be used to perform a variety of exercise for strengthening the forearm, wrist, hand, fingers and thumb.

It is an additional object of this invention to provide a device that can be conveniently kept at a person's work station to be used at regular intervals to stretch the fatigued areas of the forearm, wrist, hand, fingers and thumb and which will aid in the prevention of RMT and carpal tunnel syndrome.

It is a further object of this invention to provide a device which comprises a plurality of component parts which can be assembled to be used as a single device and which, by removal of one or more component parts, can be used for different exercises.

It is an additional object of this invention to provide a device which comprises a plurality of component parts which can be assembled to be used as a single device and which component parts can be removed and used separately for different exercises.

These and other objects of the invention which will become apparent hereinafter are achieved by the provision of an exercise system comprising a plurality of components assembleable into a plurality of configurations on which a person can perform a variety of exercises to strengthen the forearm, wrist, hand, fingers and thumb, the exercise system including a main body comprising first and second body members, each having an inside surface, an outside surface, and first and second arms extending upwardly from a base portion; first and second cross members, each having two ends and a horizontal length, said first cross member being coupled between said first arms and said second cross member being coupled between said second arms; and a grip coupled between said base portion of said first body member and said base portion of said second body member; rocker means, attachable to the bottom of said body members, to form a curved surface enabling said main body to be rocked back and forth; and first and second handles, said first handle being removeably attached to the outer side of said first body member and said second handle being removeably attached to the outer edge of said second body member.

BRIEF DESCRIPTION OF THE DRAWINGS

FIG. 7 is a side view (7*a*), front view (7*b*) and top view (7*c*) of a handle of the present invention;

FIG. 8 is a side view (8*a*) and top view (8*b*) of a handle lock of the present invention;

DESCRIPTION OF THE PREFERRED EMBODIMENTS

Figure 1:
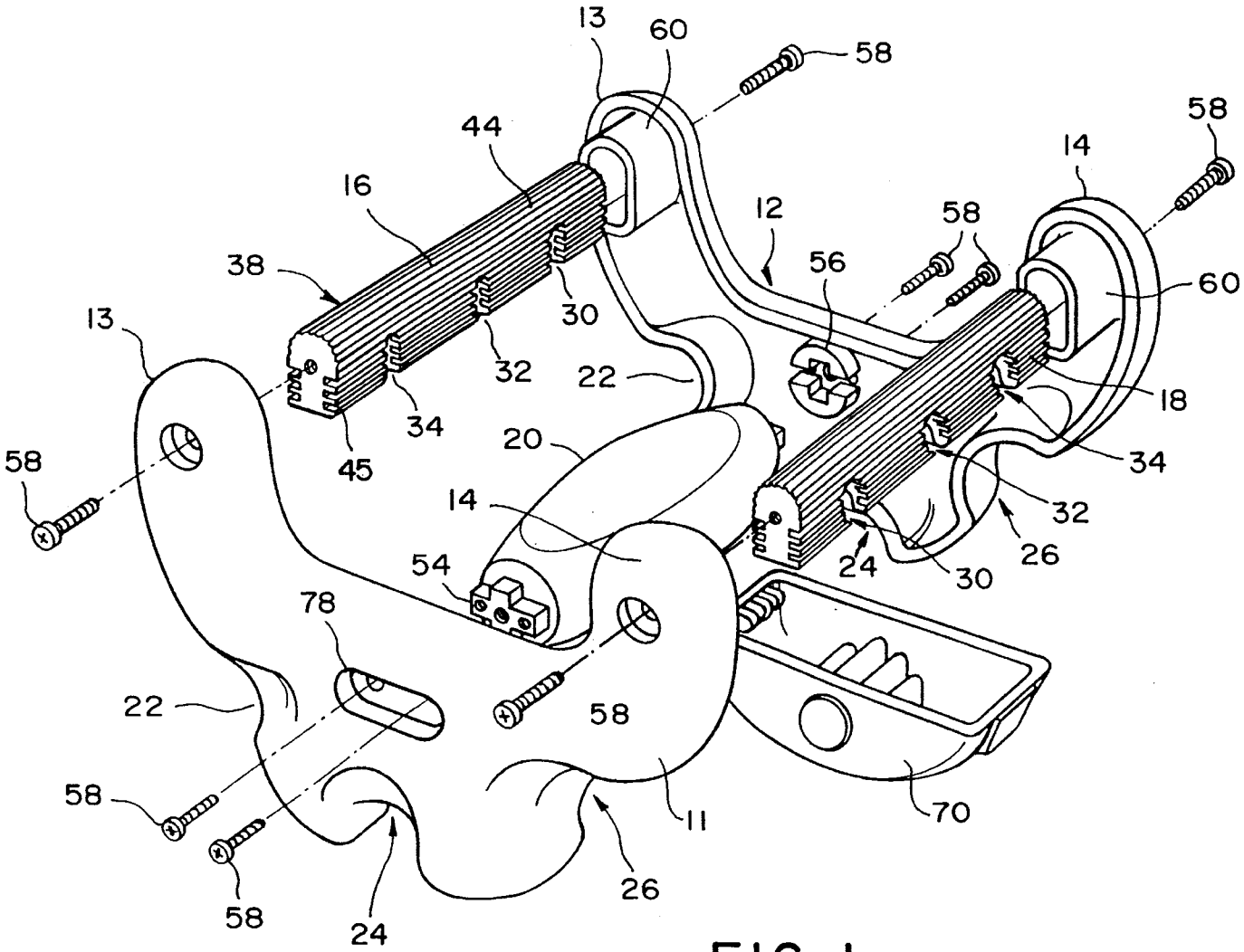
FIG. 1 is an exploded perspective view of the device according to the present invention with tension bands and handles removed.
Figure 2:
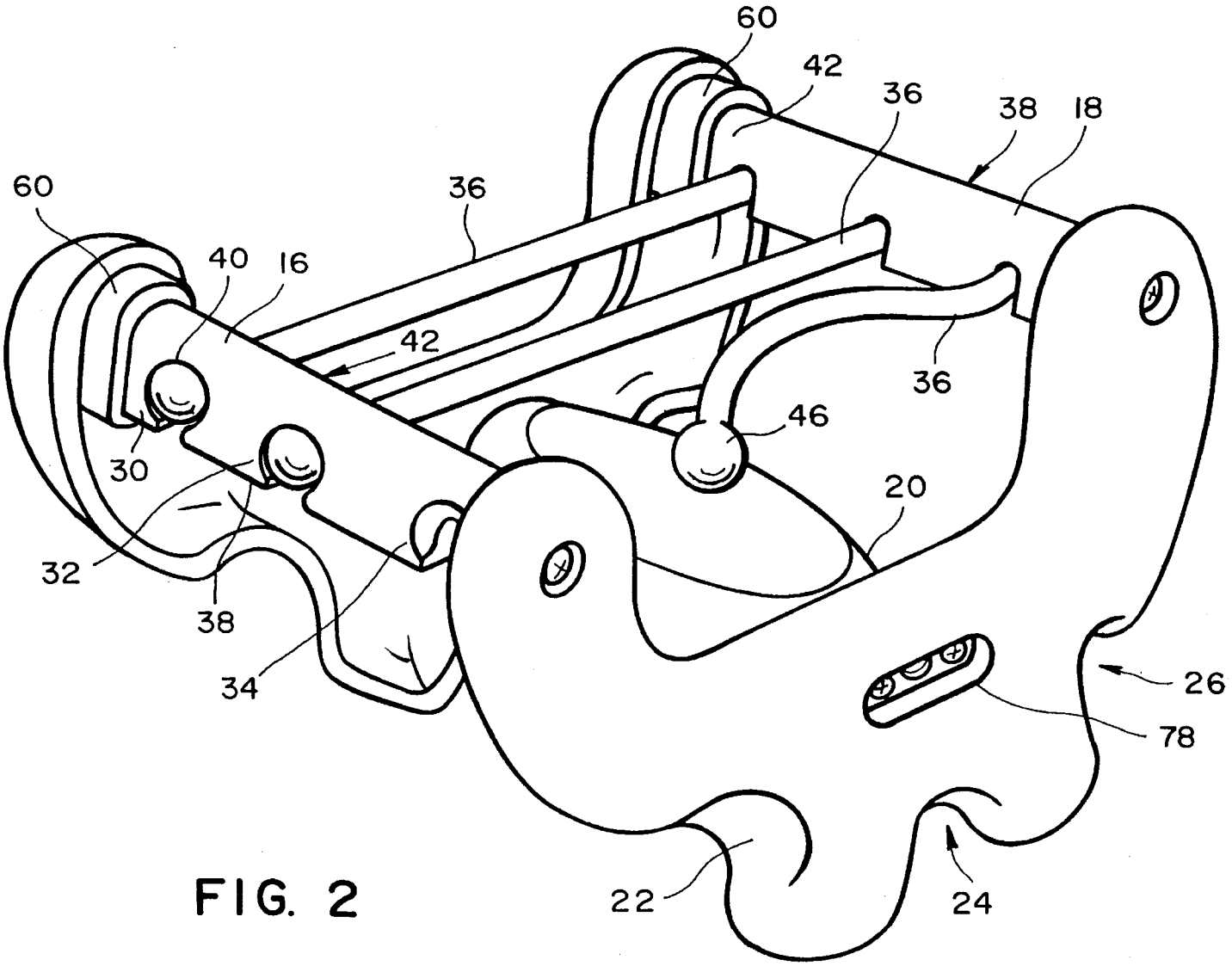
FIG. 2 is a perspective view of the device of the present invention with tension bands inserted and with anti-skid rocker boots and handles removed.

FIG. 1 is an exploded perspective view of the device according to the present invention with the tension bands, handles, and one of the anti-skid rocker boots (all described more fully below), removed. FIG. 2 is another perspective view of the device of the present invention, this time with the tension bands inserted and with both anti-skid rocker boots and the handles removed. The individual component parts that are coupled to form the device of FIGS. 1 and 2 are shown individually in FIGS. 3–7 and are described separately for purposes of explanation and understanding. As set forth below, certain of the component parts are themselves used for certain exercises, and various combinations of them, including the fully assembled combination shown in FIG. 1, are used for other exercises.

Referring now to FIGS. 1–7, a main body 10 comprises body members 11 and 12, cross members 16 and 18, and grip 20. The body members 11 and 12 are identical and include arms 13 and 14 and base portion 15. Formed on base portion 15 are three thumb slots 22, 24, and 26 which provide a comfortable place to insert the thumbs or the fingers of the user when performing certain exercises. The body members are formed of, for example, rigid plastic by the process of injection molding. In the preferred embodiment, structural ribbing 28 (see FIG. 3) is included to maintain the rigidity of the body members 11 and 12.

Cross members 16 and 18 comprise identically formed members constructed as shown in FIG. 4. Each cross member 16 and 18 is, in the preferred embodiment, approximately 5 inches in length, although, obviously, this length may vary. An end view (FIG. 4*a*) and cross-sectional end view (FIG. 4*b*) shows that the cross-section of cross members 16 and 18 is generally the shape of an upper-case letter "D". Each cross member 16 and 18 includes three slots, 30, 32 and 34 which accept the ends of tension bands 36 and hold them firmly in place during use. As shown in FIGS. 4*b*–4*d*, on the outermost side 38 of each cross member 16 and 18 the slots are rounded in shape and open on the bottom. This rounded out portion forms a socket area 42, the purpose of which will be described below. On the innermost side 42 of each cross member 16 and 18 the slots are "U" shaped, and are also open at the bottom, as shown.

In FIG. 1, and as detailed in FIG. 4, the preferred embodiment is exemplified with regard to cross member 16. In the preferred embodiment, the top portion 44 of each cross member (the curved portion of the "D" cross-section) has grooves formed along the length of the cross member, to minimize slipping of the hands and/or fingers during use. Along the sides of each cross member, slots 45 are formed to reduce the amount of material used. Both cross members should be identical; however, for purposes of explanation, only cross member 16 in FIG. 1 is shown constructed in this manner. Obviously, the cross member could be constructed as a generally solid piece as shown by item 18 in FIG. 1.

The cross members serve several purposes. Cross members 16 and 18 are secured between body members 11 and 12 as shown in FIG. 1 and, combined with the grip 20, which is attached as described below, provide a strong structure to enable the device to be used for it's intended purpose.

Sockets 40 in cross members 16 and 18 enable the insertion of tension bands 36 for use with certain exercises. The bulbous ends 46 of tension bands 36 (see FIG. 10) are inserted in the slots 30, 32 and 34 and are kept in place when tension is delivered to the bands by the user. The bulbous ends 46 of tension bands 36 seat into the sockets 40 to keep the tension bands 36 in place.

Figure 5A:
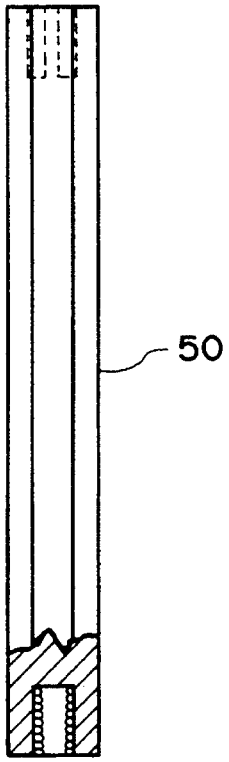
FIG. 5 is a partial cross-sectional front view and end view (5*a* and 5*b*, respectively) of a grip cross member and a front view and end view (5*c* and 5*d*, respectively) of the grip, including the grip cross member, of the present invention.
Figure 5C:
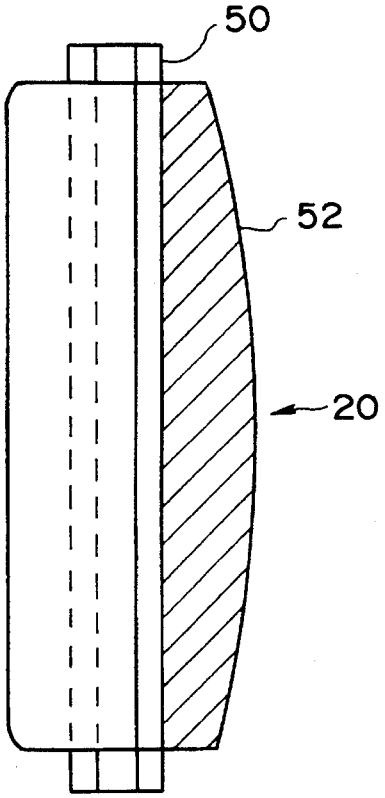
Figure 5B:
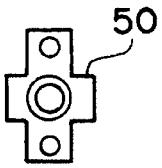
Figure 5D:
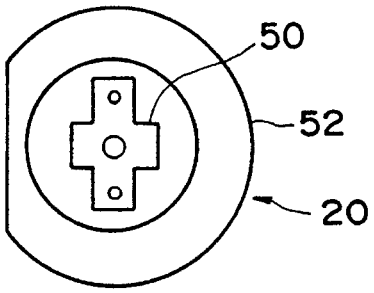

Grip 20 is shown in detail in FIGS. 5*a*–5*d*. Grip 20 comprises a grip cross member 50 which, in the preferred embodiment, is formed of molded plastic. FIG. 5*a* shows the grip cross member 50 separate from the complete grip 20. A cross-section of grip cross member 50 is cross-shaped as shown in FIG. 5*b*. The grip cross member 50 is covered with a padding of neoprene or other similar material, so that it provides a spongy handle 52 around the grip cross member 50 as shown in FIG. 5*c*. The ends of grip cross member 50 extend beyond the end of the spongy handle 52. This configuration allows the grip 20 to be coupled to the body members 11 and 12 by coupling the ends of the grip cross member 50 to the grip sockets 56 formed on the inside surface of body members 11 and 12. This provides a strong grip which will not rotate because the cross-shaped grip cross member 50 mates with cross-shaped female grip socket 56.

Grip 20, like the cross members 16 and 18, also serves two basic purposes. Grip 20 is inserted between the body members 11 and 12 and is secured in such a way that it, like the cross members 16 and 18, adds to the structural integrity of the device. This three-point attachment of one body member 11 to the other body member 12 provides a strong structure that can withstand the rigors of the variety of exercises that are performed using the device.

The grip 20 also serves as a handle for grasping the device during certain exercises and, due to the compressible handle, is utilized as a "squeeze bulb" which can be squeezed by the user to improve the hand muscles, much in the same manner as one might squeeze a tennis ball to improve hand strength.

Figure 3C:
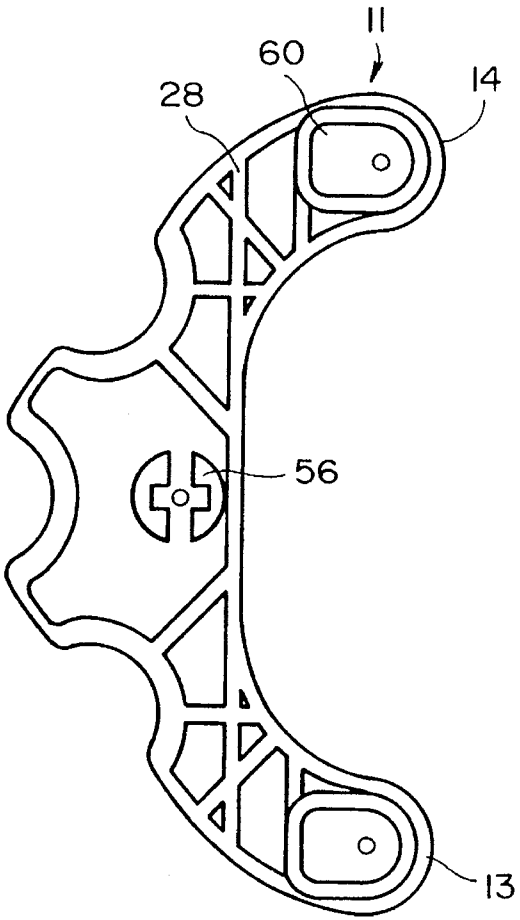
FIG. 3 is a top view (3*a*), a side view (3*b*) and a bottom view (3*c*) of one of the body members of the present invention.
Figure 3B:
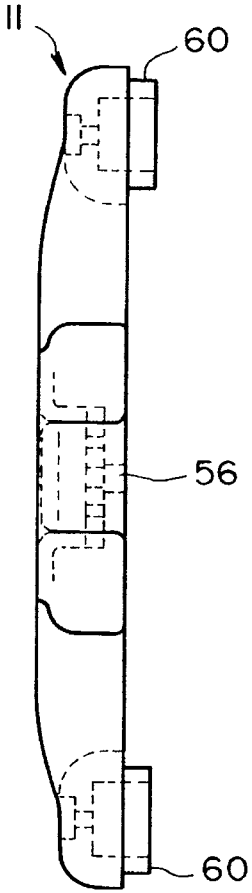
Figure 3A:
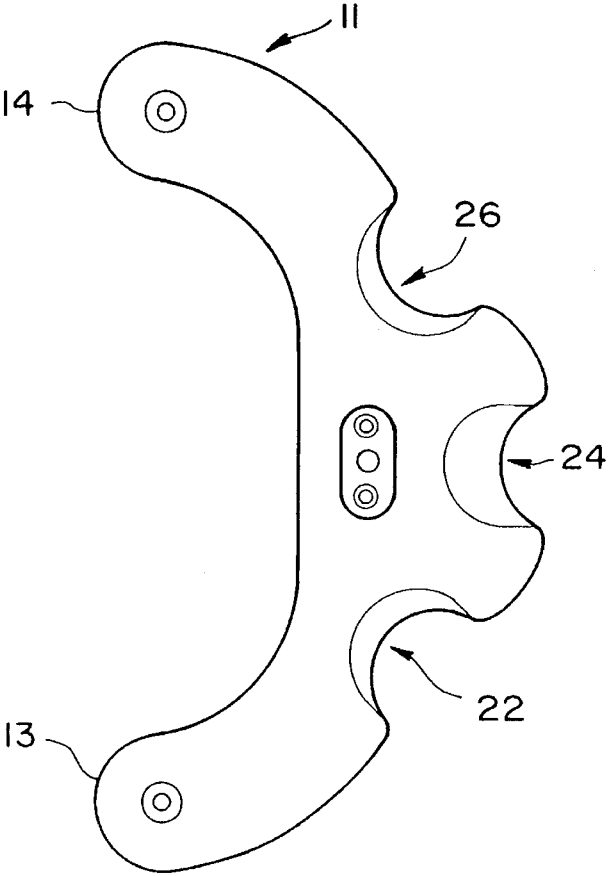
Figure 4B:
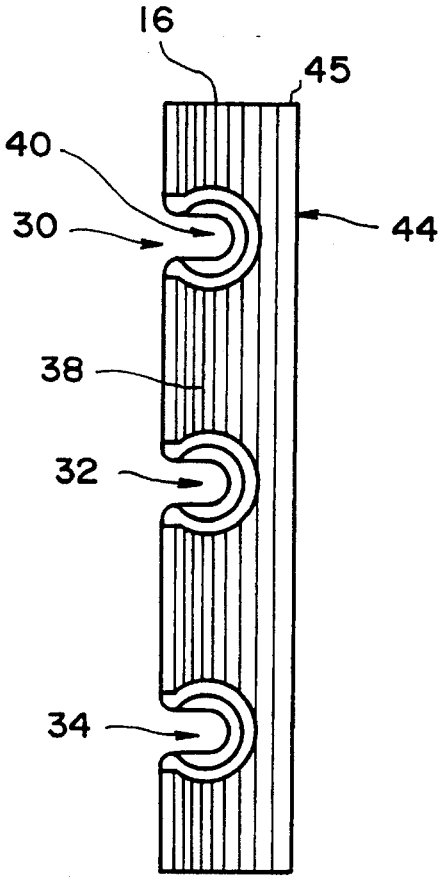
FIG. 4 is an end view (4*a*), outer side view (4*b*), front view (4*c*) and inner side view (4*d*) of one of the cross members of the present invention.
Figure 4C:
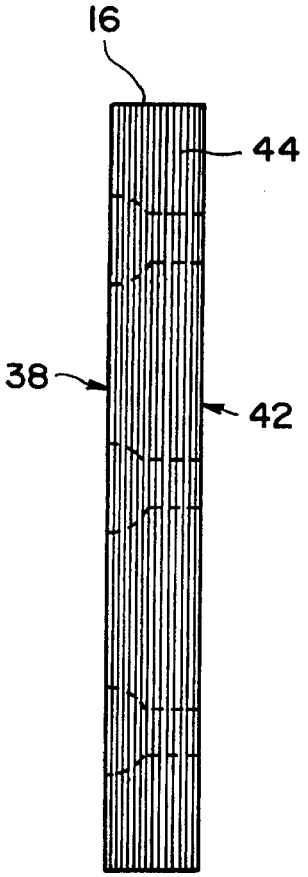
Figure 4D:
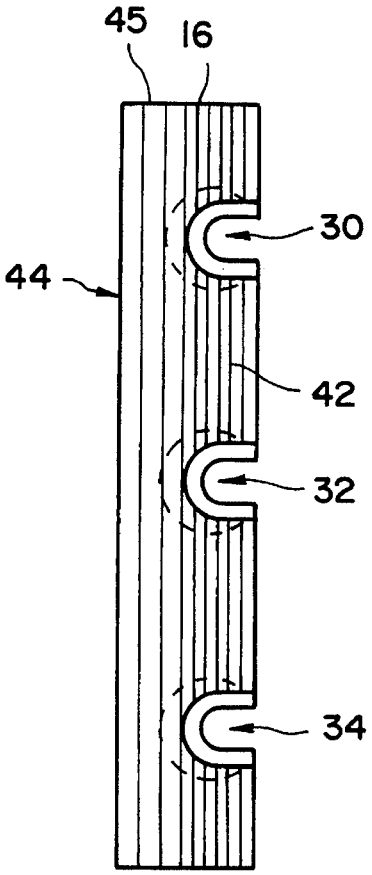
Figure 4A:
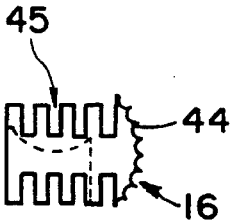

The precise configuration for connecting the two body members 11 and 12 to each other via the two cross members 16 and 18 and the grip 20 can take many forms; the basic idea is that they be connected so that the cross members 16 and 18 and grip 20 are situated between the two body members 11 and 12 and fastened securely thereto using, for example, screws 58 shown in FIG. 1. In the preferred embodiment, shown with reference to FIGS. 1–3, receiving sockets 60 are formed on the inner surface of each body member 11 and 12. The cross members 16 and 18 are then inserted into the receiving sockets 60 and a screw is threaded into the cross members 16 and 18 through the body members as shown in FIG. 1. In addition to improving the structural integrity of the device, using the receiving sockets 60 simplifies the assembly of the device because the shape of the receiving socket will help to orient the cross member inserted therein in the proper direction. Similarly, the grip 20 is mated with the grip sockets 56; however, the grip sockets 56 include a female "cross-shaped" portion as shown in FIGS. 1 and 3 which engages with a male "cross-shaped" portion formed by the end of the cross member 50. Threaded screws 58 are then inserted through the body members and into a threaded portion of the grip cross member 50. This prevents the grip from rotating.

Figure 6C:
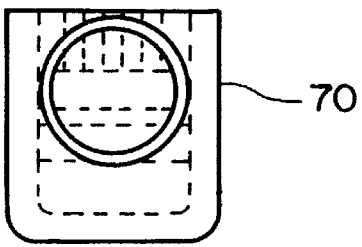
FIG. 6 is a top view (6*a*), front view (6*b*) and side view (6*c*) of an anti-skid rocker boot of the present invention.
Figure 6A:
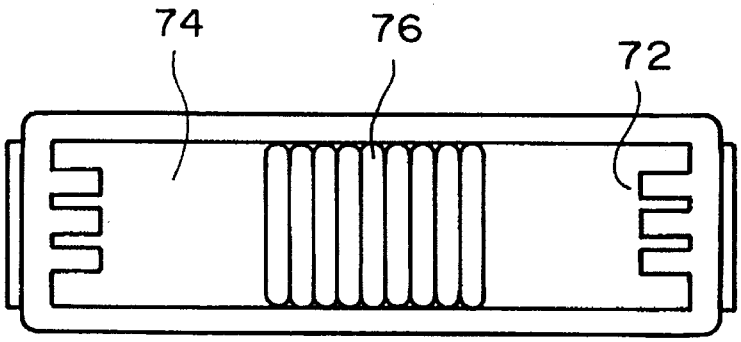
Figure 6B:
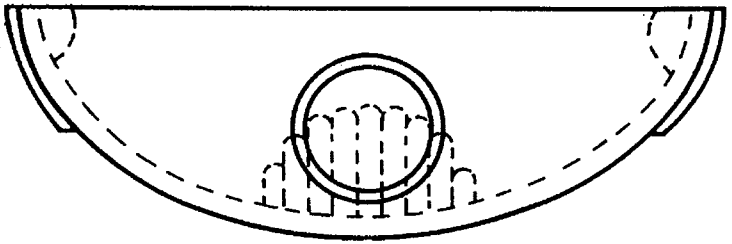

In FIG. 6, an anti-skid rocker boot 70 is shown. A pair of anti-skid rocker boots 70 are fitted over the thumb slots of base portion 15 (one rocker boot over each base portion) to form rocker means. The anti-skid rocker boots 70 are made of a moldable elastic material such as "flexible" PVC or rubber. As shown in FIG. 6, each anti-skid rocker boot includes "toothed" or "ribbed" portions 72 and 74. These toothed portions keep the boots firmly in place when they are fitted over thumb slots 22, 24 and 26 (see FIG. 1); because the entire boot, including the toothed portions, is made of flexible material, it can be stretched slightly to enable it to be pulled over the thumb slots, and the toothed portions then press firmly against the sides of thumb slots 22 and 26 to help keep the boot in place.

As shown in FIG. 6, each anti-skid rocker boot also includes a set of filler "ribs" 76 which fit into the portion of the thumb slots 24 designed to accommodate the users thumb when the boots are removed. In addition to providing rigidity to the rocker boot when it is being used on the base structure 10, ribs 76 also provide a measure of rigidity when the boots are being used independently as an exercise device.

When the anti-skid rocker boots 70 are fitted over the thumb slots, they provide a rocker means having a smooth curved surface enabling the device to be rocked easily when being used for flexion exercises of the elbow, wrist and forearm as described more fully below. The anti-skid rocker boots 70 also prevent the device from skidding when it is being used for this exercise.

FIGS. *7a–7c* show detachable handles 80, which can be coupled to body members 11 and 12. Each handle 80 is formed of a plastic shaft portion 82 having a keyed end 84 which is keyed to mate with key-slots 78 on body members 11 and 12. Each plastic shaft 82 is tubular, i.e., it is hollow along it's length so that handle lock 86 (see FIGS. 8*a* and 8*b*) can be inserted therein. The shaft portion 82 can be covered with a foam outer grip to decrease the likelihood that the hands of the user will slip when using the device.

Figure 9:
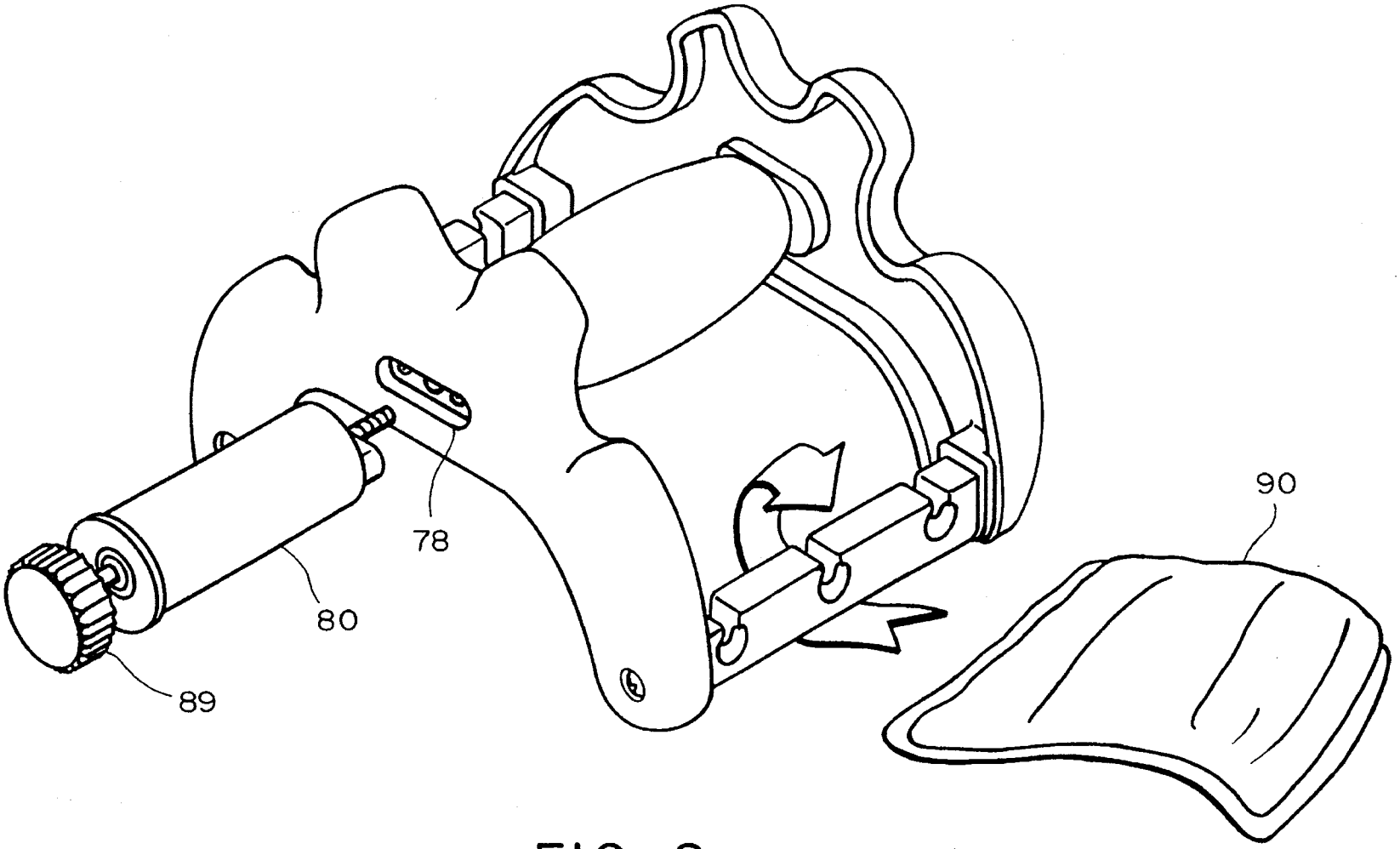
FIG. 9 is a perspective view showing the attachment of the handles and a weight wrap of the present invention.

To attach handles 80 to the body members 11 and 12, the keyed end 84 is inserted into key slot 78 as shown in FIG. 9. The shaft portion 87 of handle lock 86 is then inserted through the handle 80, and entire shaft, including the threaded end 88, is turned, thereby fastening the handle to the grip 20. The shaft portion 87 is turned by turning knob 89 in the desired direction.

Figure 10A:
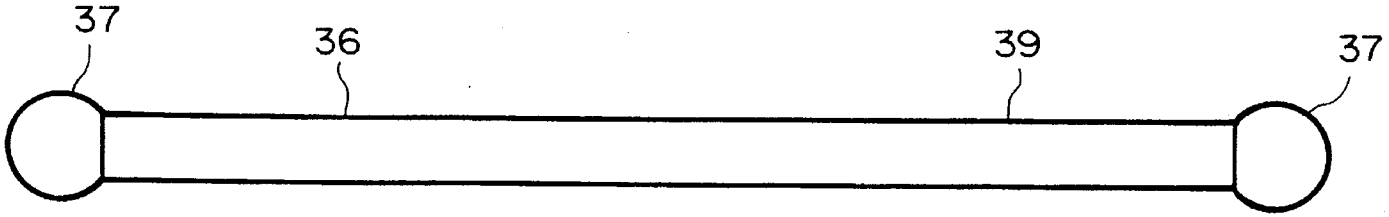
FIG. 10 is a top view of a high tension (10*a*), medium tension (10*a*) and light tension (10*c*) tension band of the present invention.
Figure 10B:
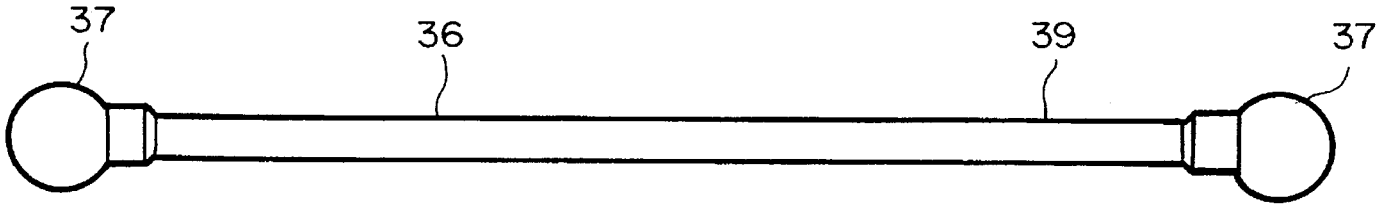
Figure 10C:
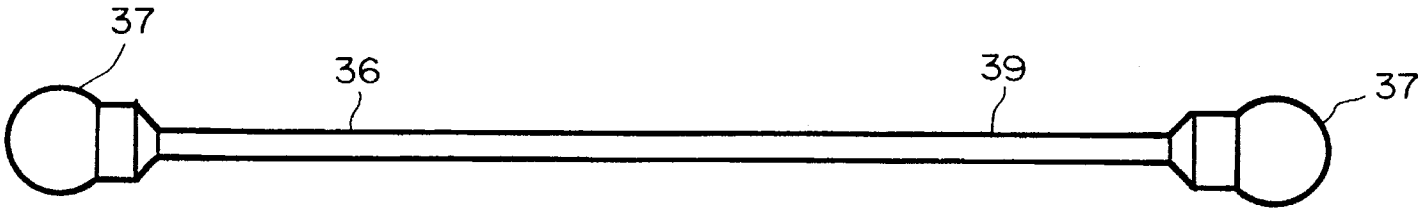
Figure 22:
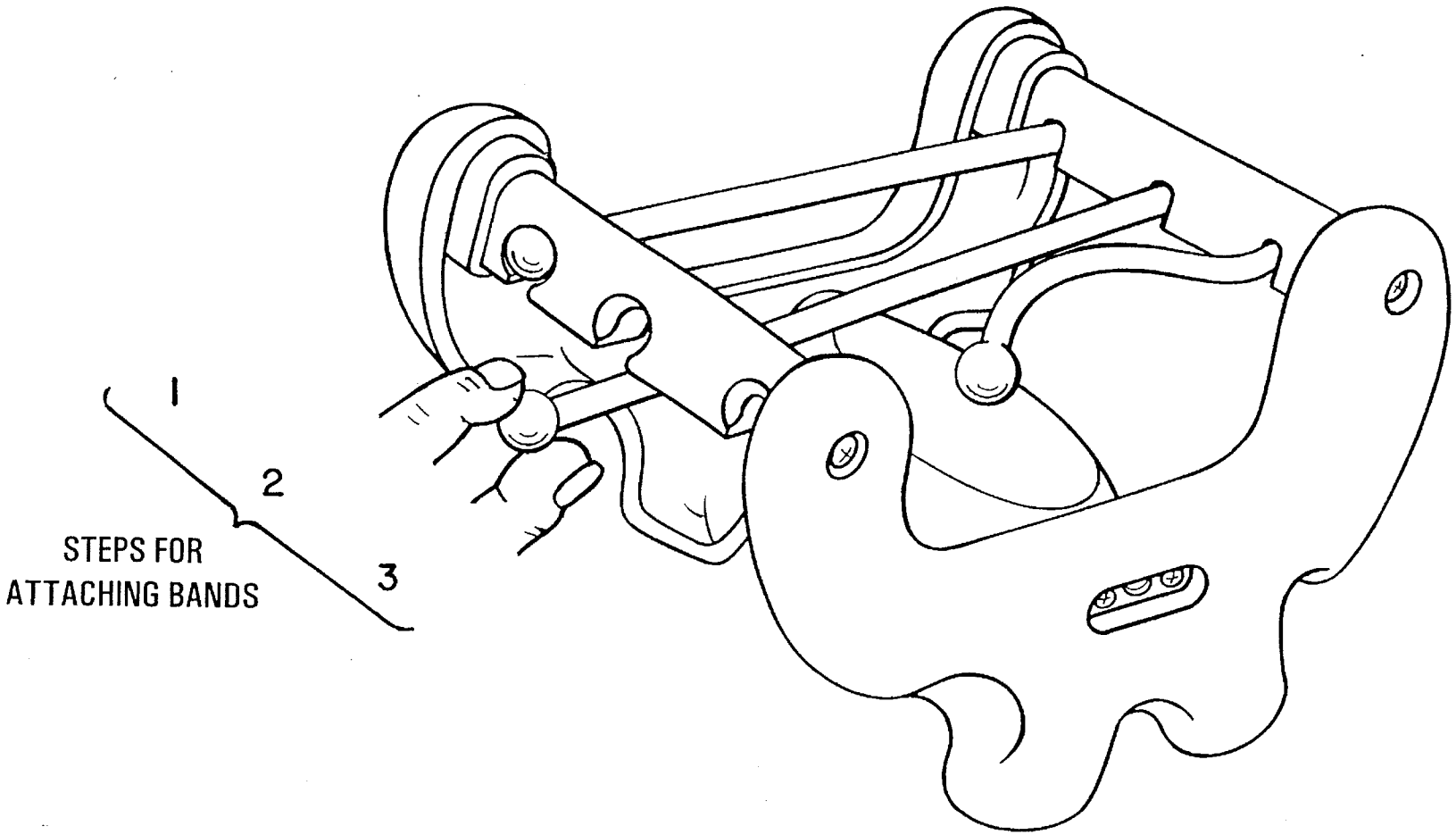
FIG. 22 is a perspective view showing how the tension bands are inserted into the cross members of the present invention.

The tension bands 36 are removable so that bands of varying tensions can be used dependant on the needs of the user. In addition, when using the weight wraps discussed below, the bands need to be removed so that the weight wraps can be attached. Each tension band has two bulbous ends 37 as shown in FIG. 10 so that the ends can be inserted into slots 30, 32 and 34 in cross members 16 and 18 (FIG. 22 shows a technique for inserting bands 36). By varying the thickness of the corded portion 39 (see FIG. 10*a*–10*c*), the tension of the bands can be higher or lower. The tension bands are, in the preferred embodiment, made of elastic material such as rubber; if a thicker and/or denser corded portion is used as shown in FIG. 10*a*, the tension provided by the band will be greater, and if a thinner and/or less dense corded portion is used as shown in FIG. 10*c*, the tension provided by the band will be less.

Figure 11B:
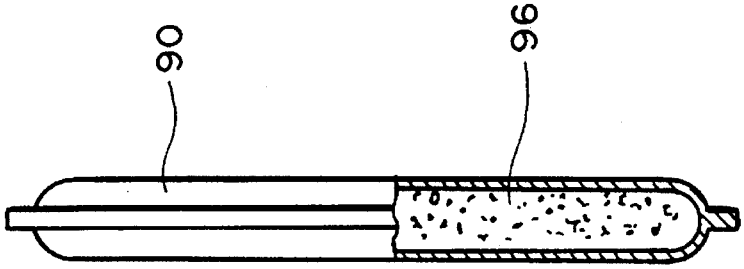
FIG. 11 is a front view (11*a*) and a partial cross-sectional side view (11*b*) of a weight wrap of the present invention.
Figure 11A:
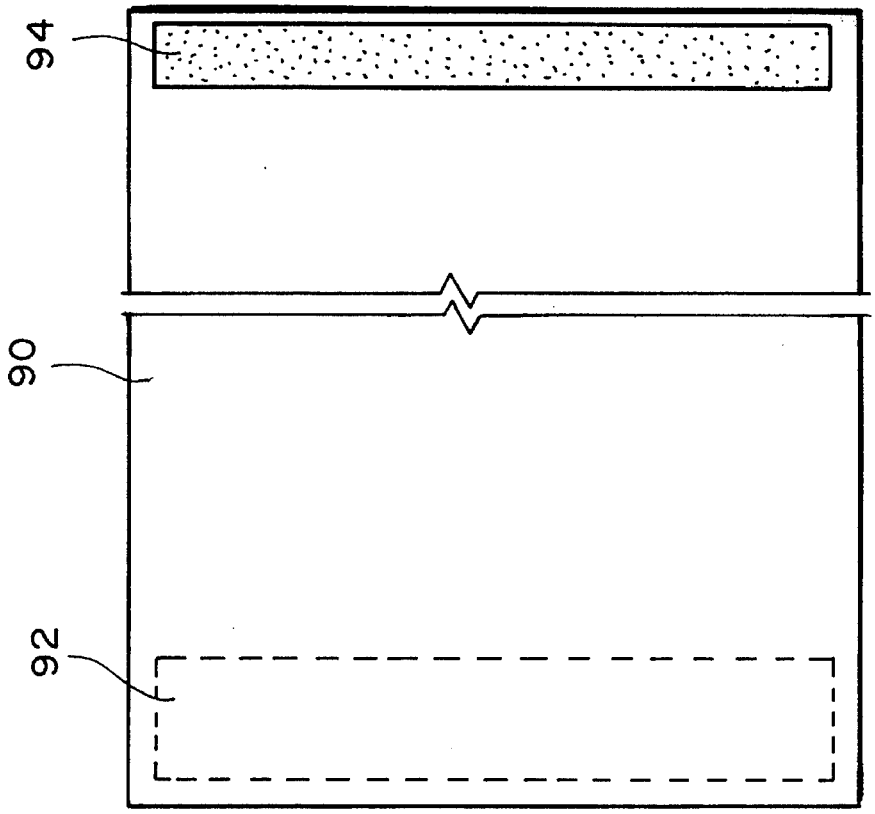

The final component of the exercise device is the weight wrap 90, shown in detail in FIG. 11. The weight wrap is similar to commonly known ankle weights or wrist weights. They comprise a generally flat "bladder-shaped" pouch having fastening strips 92 and 94, such as Velcro, on either end. The pouches contain predetermined amounts of sand 96 or other material to supply the desired amount of weight and can be wrapped around the cross members 16 or 18, when the tension bands are removed, as shown in FIG. 9. They are secured in place by the Velcro strip material 92 and 94.

As noted above, the device provides a complete system for exercising the hands, wrists, elbows, forearms and fingers. Various exercises and the configuration required to perform the exercises are described below.

Figure 12:
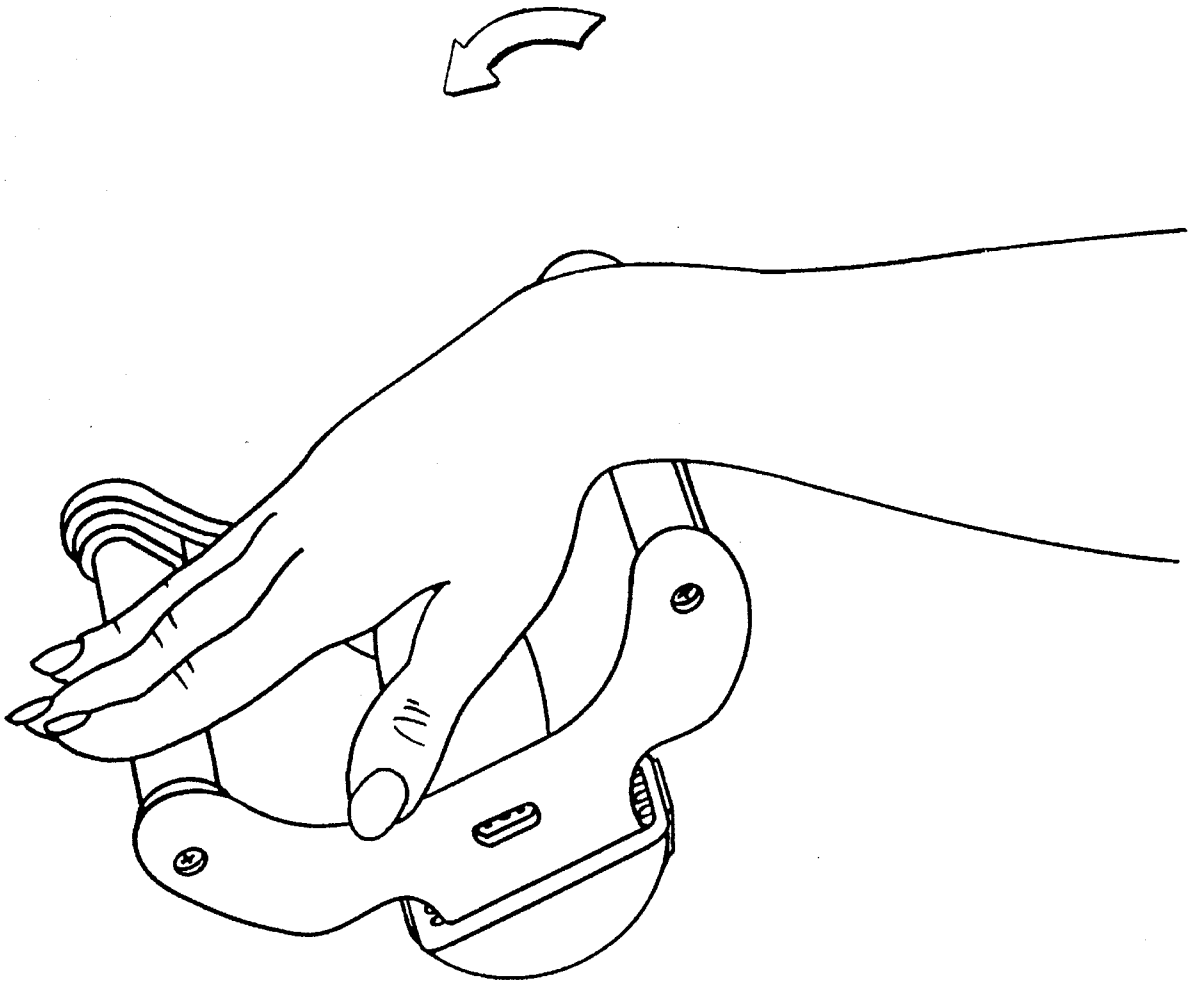
FIG. 12 is a perspective view showing use of the present invention for flexion of the wrist, elbow and forearm.

Flexion of the elbow, forearm and wrist can be accomplished by using the device with the handles 80 and the weight wraps 90 removed and the anti-skid rocker boots 70 in place; the tension bands 36 can either be inserted or removed for this exercise. The device is turned so that both anti-skid rocker boots 70 are facing downward, in contact with the floor or a table top. The user's hand rests across the two cross members 16 and 18, with the finger tips on one cross member and the base of the hand (the area where the wrist and hand come together) resting on the other cross member as shown in FIG. 12. The hand is then relaxed and the device is gently rocked forward so that the cross member on which the base of the hand is resting, for example, cross member 16, is raised up higher and the other cross member, on which the finger tips are resting, for example, cross member 18, is lowered. The user holds the device in this position for a predetermined period of time, for example, 15 seconds, and then the exercise is repeated.

Figure 13:
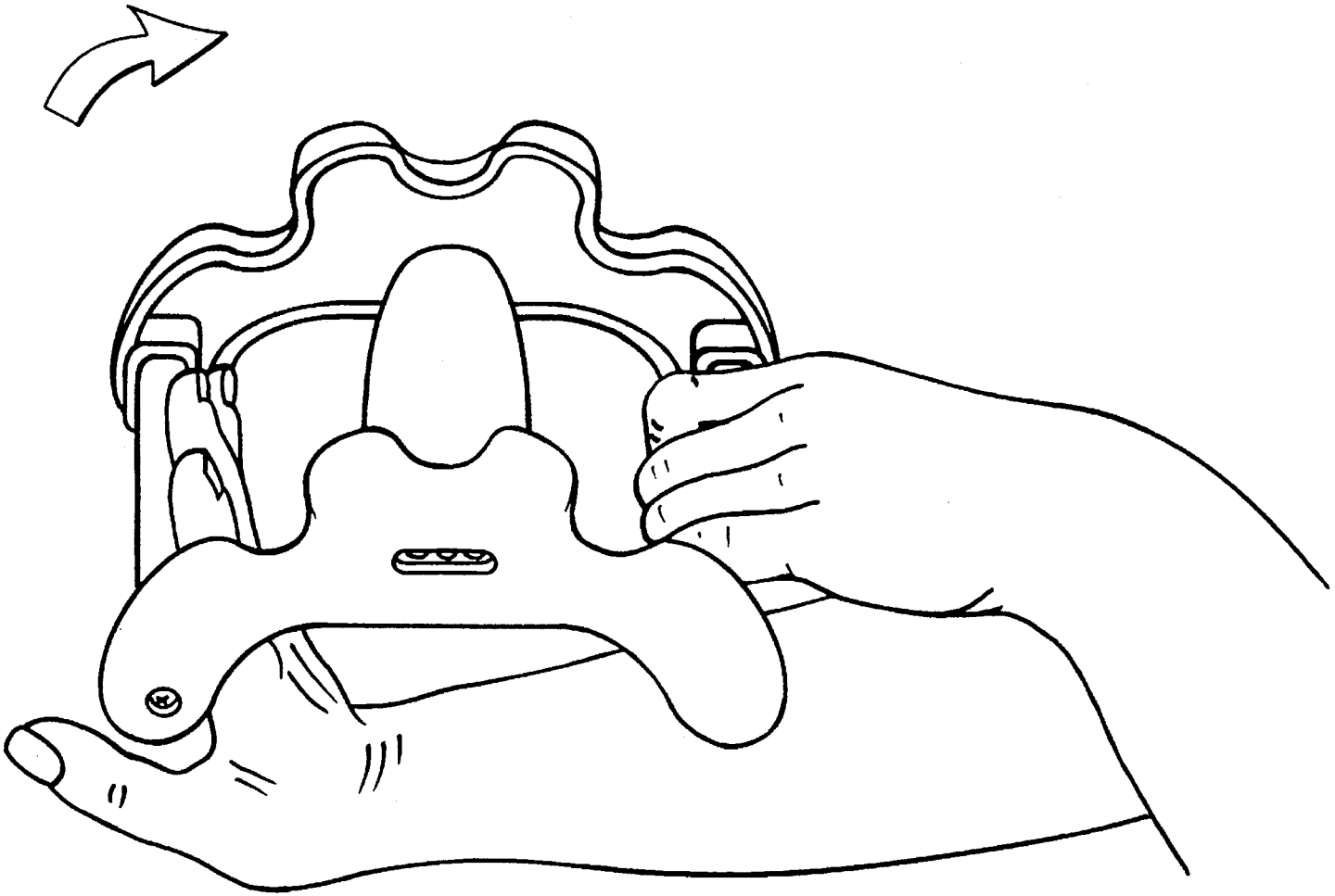
FIG. 13 is a perspective view showing use of the present invention for extension of the wrist, elbow and forearm.

Extension of the elbow, forearm and wrist can be accomplished with the device in the same configuration, although the anti-skid boots may be removed, and it would be optimal to also have the tension bands removed. For this exercise, the device is placed on a table or on the lap of the user with the thumb slot 24 facing upward (boots upward also if they are attached at this time) and with one of the cross members close to the body and one of them away from the body. The user grasps the far cross member with the right hand, palm facing downward, and grasps the near cross member with the left hand, palm facing downward as shown in FIG. 13. The right arm is then extended away from the body until the elbow is in a locked position, arm fully extended. At this point, the far cross member should be in contact with the portions of the fingers of the right hand between the finger tips and the middle section of the finger. Gently pulling the near cross member toward the body with the left hand causes a gentle stretching of the right wrist and hand. Holding the hands in this position for a predetermined period, and repeating it according to predetermined schedule is suggested. This exercise should be repeated after switching hands.

Figure 14:
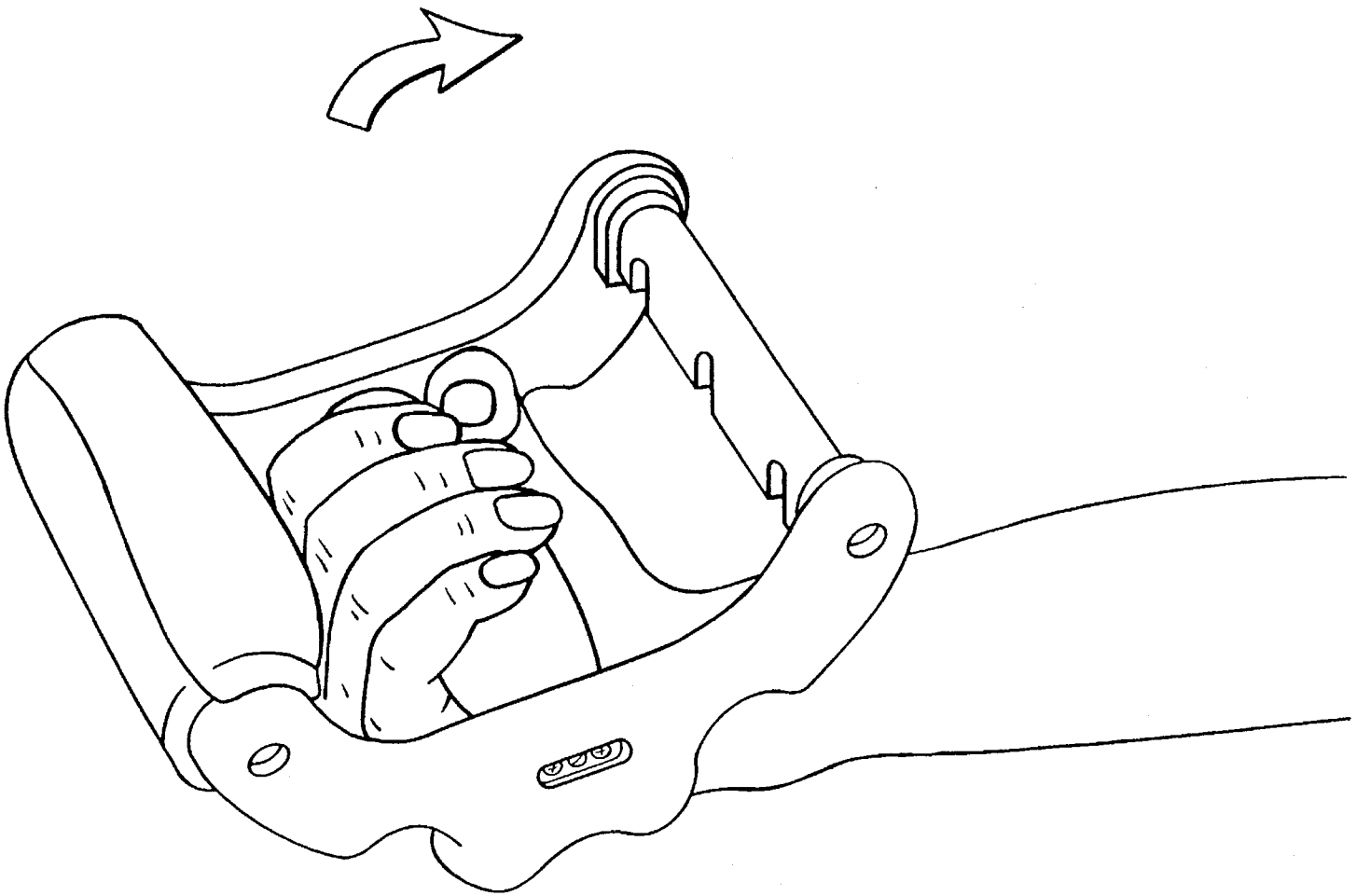
FIG. 14 is a perspective view showing use of the present invention for strengthening of the elbow, forearm and wrist.

For strengthening the elbow, forearm and wrist, the device can be converted to a "dumbbell" type device by using the weight wraps. After selecting the desired weight wrap to use, it is wrapped around one of the cross members and fastened using the Velcro strips. The user grasps the device by the squeeze grip portion 20, with the palm up and the cross member bearing the weight wrap away from the body as shown in FIG. 14. Bending the elbow to an approximate 90 degree position, the user bends the wrist into the flexed position and holds it there for a second and then returns it to the starting position. This is repeated a predetermined number of times in accordance with the prescription of the health care provider.

Figure 15:
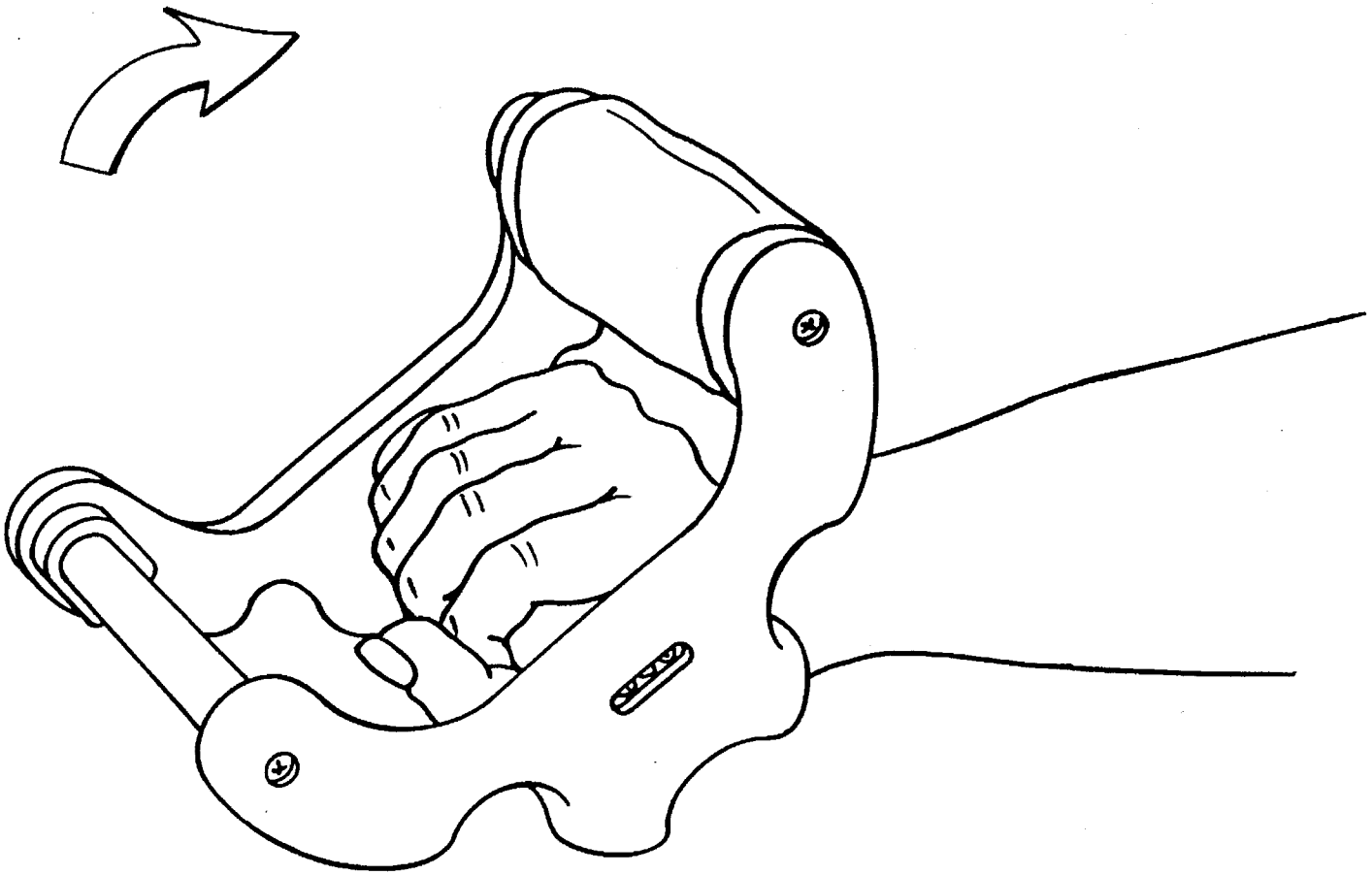
FIG. 15 is a perspective view showing use of the present invention for strengthening the extension of the elbow, forearm and wrist.

For strengthening the extension of the elbow, forearm and wrist, the same exercise is repeated, but with the palm down as shown in FIG. 15. Then, the user bends the wrist to the extended position and holds it for a second, and then returns it to the starting position, repeating the exercise as prescribed.

By attaching the handles 80 as discussed above, the device can be used for what the inventors describe as the "broom stick exercises". It has long been known to use a broom stick, either alone or with ropes and weights attached, as an inexpensive and convenient exercise assistance device. With the attached handles, the present invention can be conveniently and easily be used for the same exercises.

Figure 16:
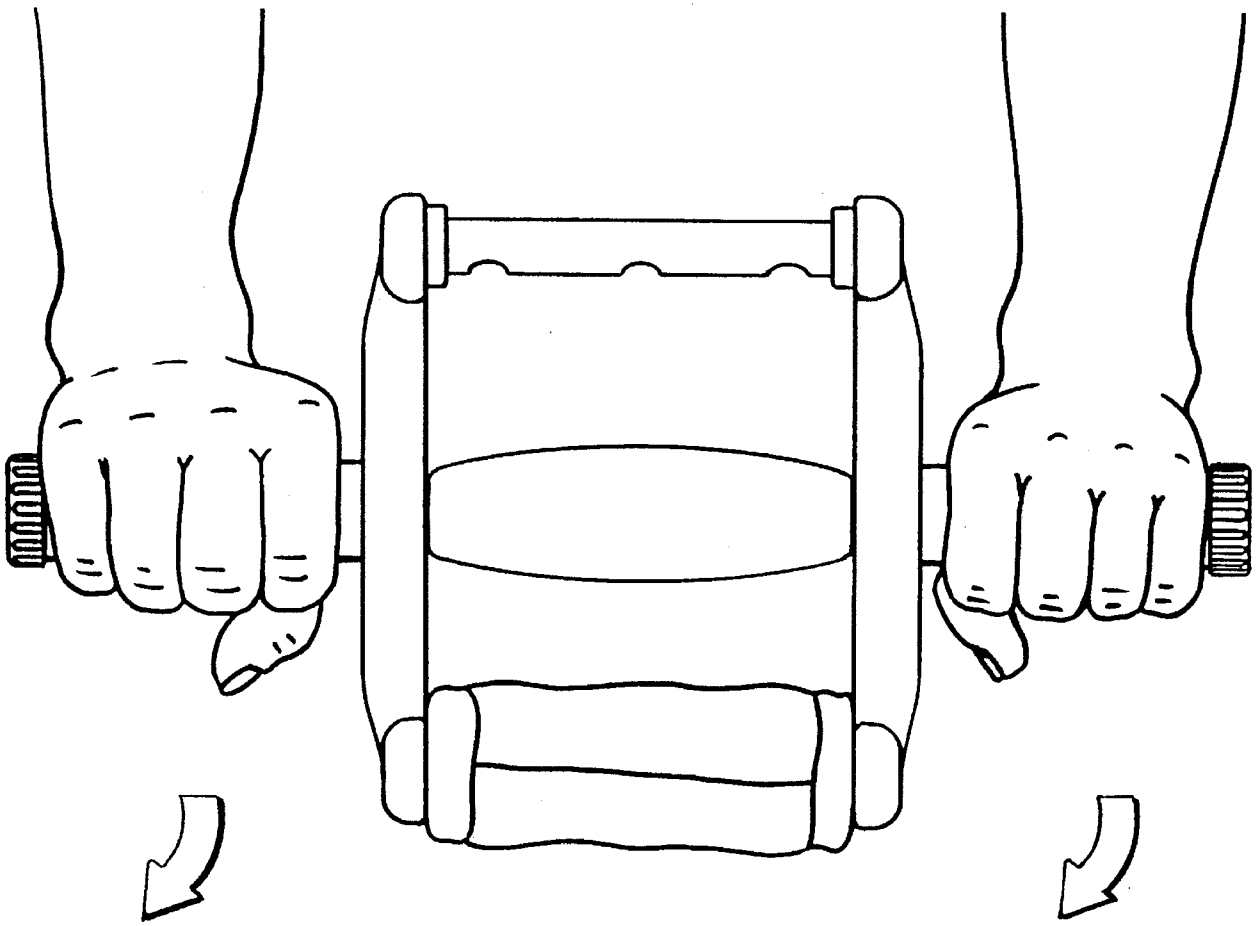
FIG. 16 is a perspective view showing use of the present invention for stretching the wrists and forearms.

For stretching the wrists and forearms, the user can hold one of the handles 80 with the palm of the hand facing downward as shown in FIG. 16. With the other hand, the user applies a gentle rotation of the other handle 80 so that the top of the device rotates away from the body. This can be repeated for a prescribed number of times, and then repeated for the opposite hand.

For stretching in the other direction, the user grasps one handle 80 with the palm facing upward, and with the other hand, rotates the other handle 80, and with it the device, so that the top of the device rotates toward the body. This exercise is repeated for the prescribed number of repetitions and then is repeated for the other hand.

Figure 17:
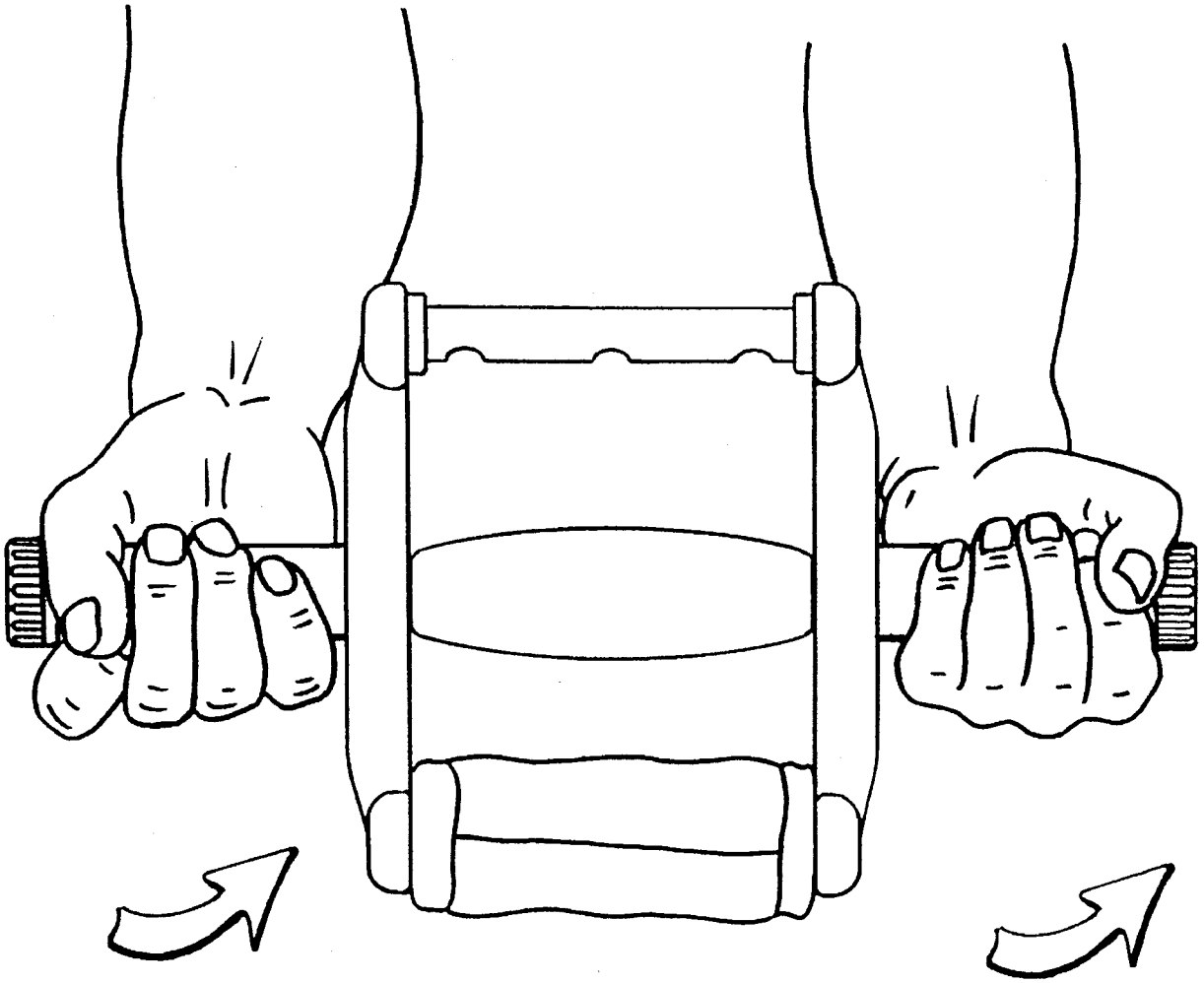
FIG. 17 is a perspective view showing use of the present invention for strengthening the wrists and forearms.

For strengthening the wrist and forearm, a weight wrap 90 is attached to one of the cross members. Grasping the handles 80 with both palms up as shown in FIG. 17, with the cross bar bearing the weight away from the body, the user rotates the device by alternately flexing the wrists on one side and then the other, so that the weight wrapped cross member moves upward with each flexing movement. After repeating this motion for the prescribed number of times, the user can then do the same exercise, but instead of flexing the wrist so that the weight moves upward with each flexing movement, the user extends each wrist, alternately, so that the weight wrapped cross member move downward, with each extending movement.

Figure 18:
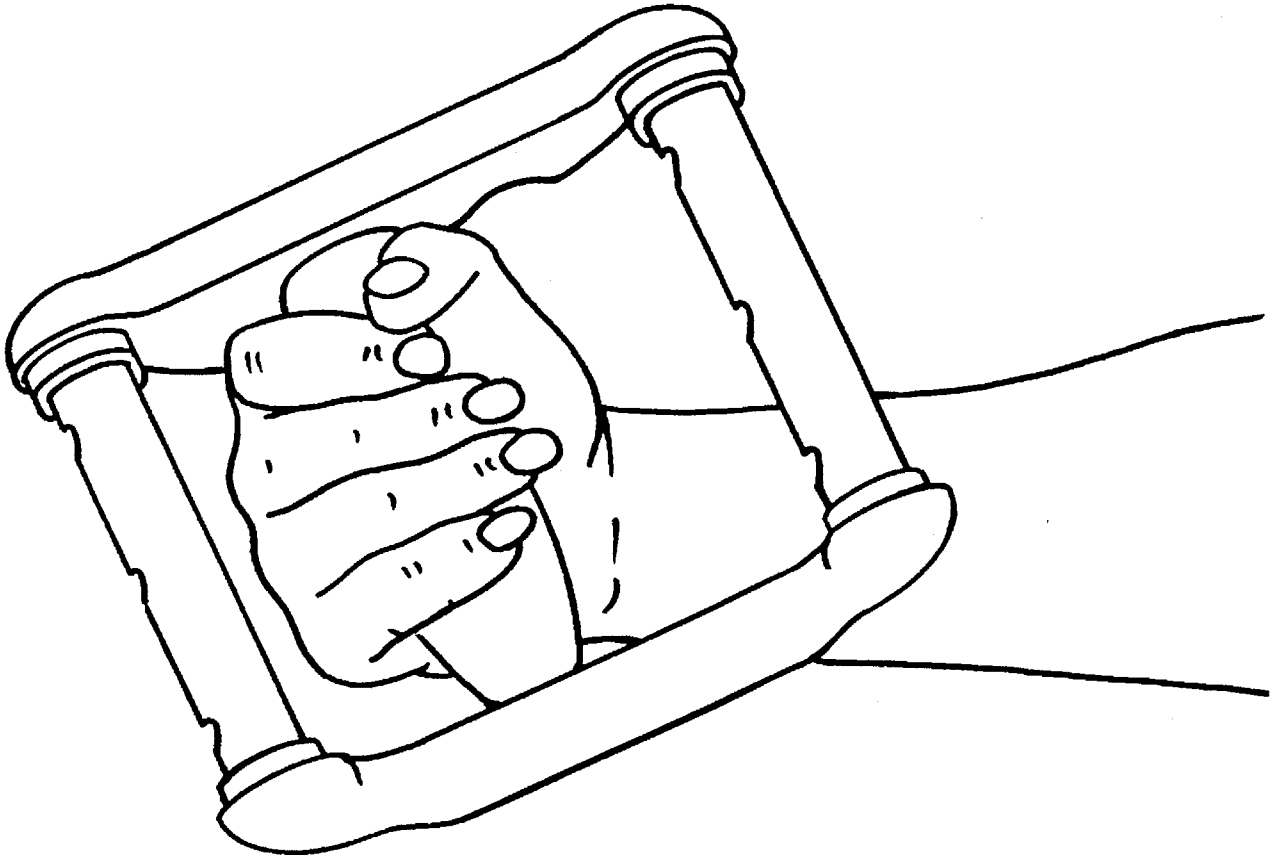
FIG. 18 is a perspective view showing use of the present invention for increasing hand strength.

For exercising the hands and fingers, the device is equipped with grip 20 which includes the compressible molded portion that forms the spongy handle 52. To use this device for increasing hand strength, the user simply can grasp the grip 20 as shown in FIG. 18 and squeeze, repeating as often as desired. The same exercise is repeated for both hands.

Figure 19:
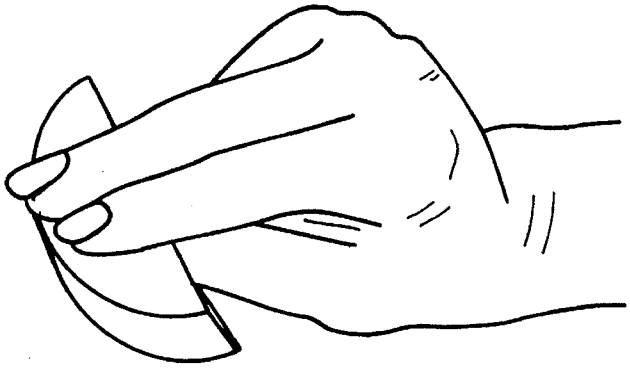
FIG. 19 is a perspective view showing use of the present invention for increasing finger strength.
Figure 20:
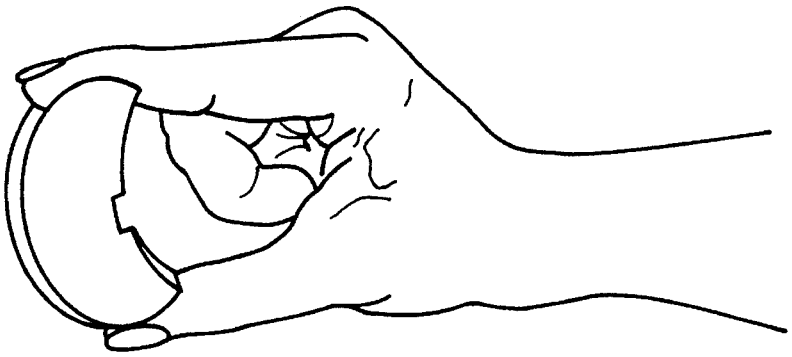
FIG. 20 is a perspective view showing use of the present invention for increasing finger strength.
Figure 21:
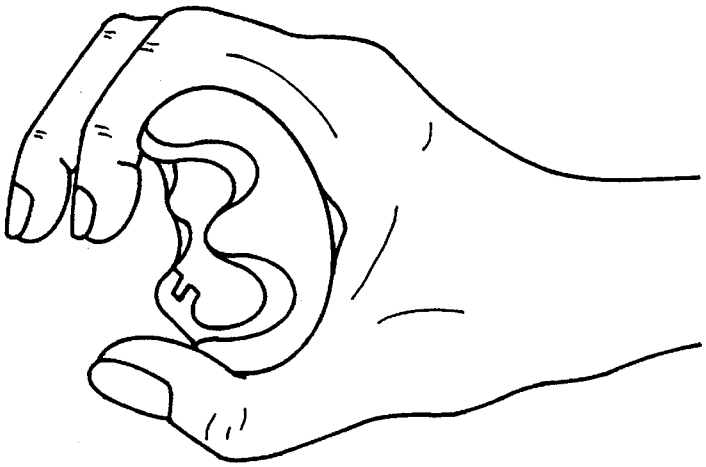
FIG. 21 is a perspective view showing use of the present invention for increasing finger strength.

To concentrate on the fingers, two exercises can be performed using the anti-skid rocker boots 70 when they are removed from the device. In the first exercise, the user pinches the sides of one of the rocker boots 70 as shown in FIG. 19, squeezing the sides together repeatedly. For increased tension, the user can pinch the ends of the rocker boot 70 towards each other as shown in FIG. 20. These exercises can be repeated over and over, and the user can switch fingers to exercise all of the fingers of the hand. The rocker boot can also be squeezed as shown in FIG. 21 to exercise the thumb and several fingers at one time.

All of the exercises described above make no use of the tension bands 36. The following exercises are performed with one or more of the tension bands 36 in place. To prepare the device for use with the tension bands, the user must install one or more of the tension bands, as shown in FIG. 22, by first placing the thinner shaft portion 39 of the band over a desired slot in one of the cross members. The thin portion is then pushed into the slot, and then the other end of the band is pulled so that one of the bulbous portions 37 is pulled into place in the socket. Next, the user pulls the other bulbous end 37 to stretch the tension band, allowing the thin portion near the other bulbous portion to be inserted into the other slot. Once the thin portion is in the slot, the user can release the bulbous portion, and the tension of the band will pull the other bulbous portion into place in the other socket. Finally, for the tension band exercises, the anti-skid boots should be removed.

Figure 23:
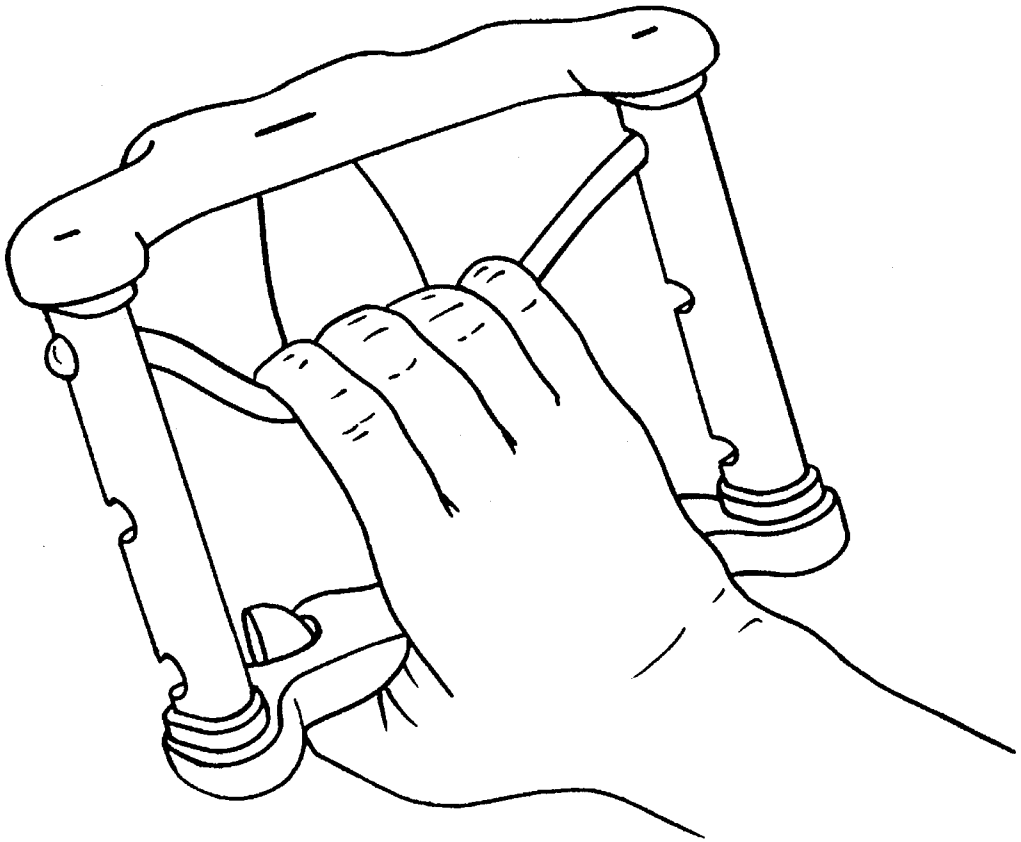
FIG. 23 is a perspective view showing use of the present invention to strengthening the grip.

To provide for strengthening of the grip, the user utilizes the thumb slots and the tension bands. To allow for different size hands, the device is equipped with three different thumb slots and three different locations for the tension bands. The user places the thumb in one of the thumb slots and places the fingers across the top of the tension bands and then hooks one of the bands with the finger tips as shown in FIG. 23. The band should be selected that produces a significant amount of tension when it is pulled. With the thumb and fingers in this position, the user should pull or squeeze the bands, holding for a predetermined period of time (e.g., a count of five), and then release. This should be repeated according to a schedule prescribed by the health care provider.

Figure 24:
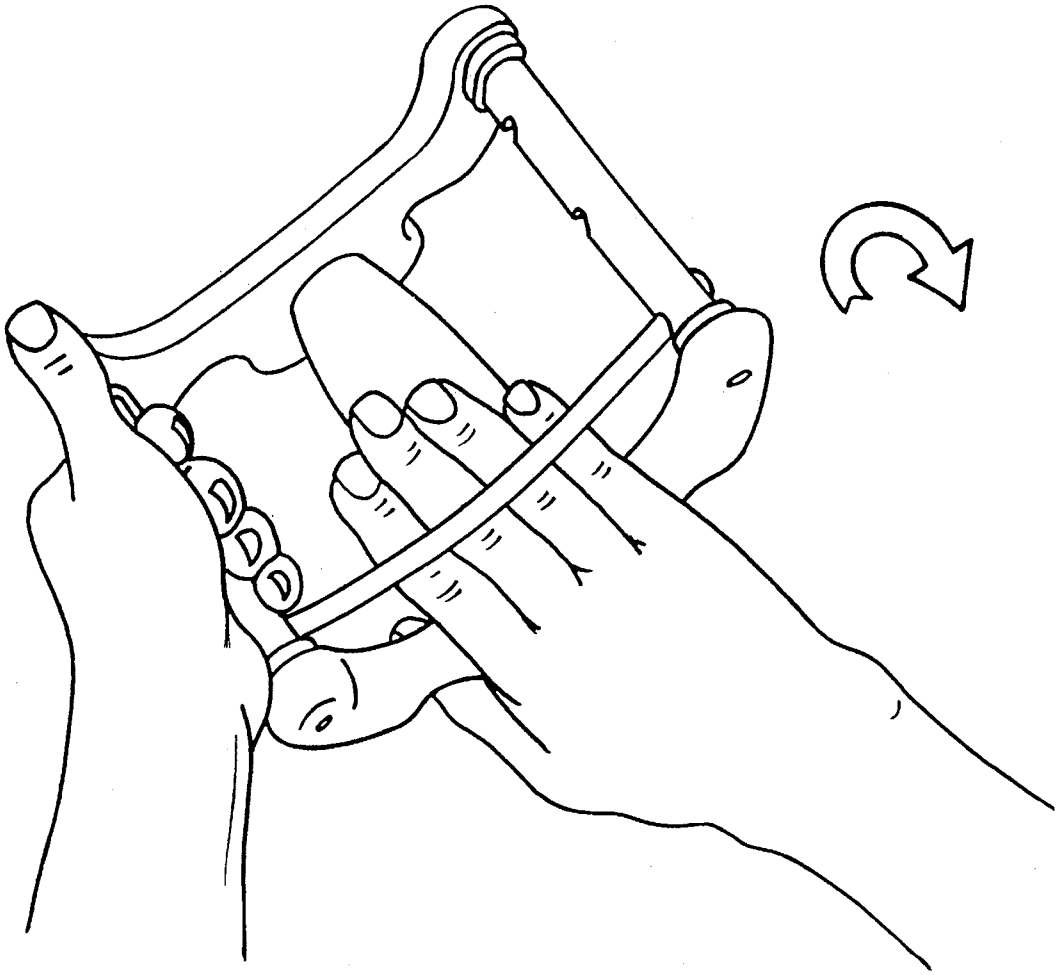
FIG. 24 is a perspective view showing use of the present invention for developing the extension capabilities of the hand.

For developing the extension capabilities of the fingers and hand, the device can be held in the same orientation as above, but the fingers are slipped under the tension bands as shown in FIG. 24. By then extending the fingers outward (away from the palm) and holding for a predetermined period of time (e.g., a count of five), and then repeating, the user strengthens the extension capabilities of the fingers and hand.

Figure 25:
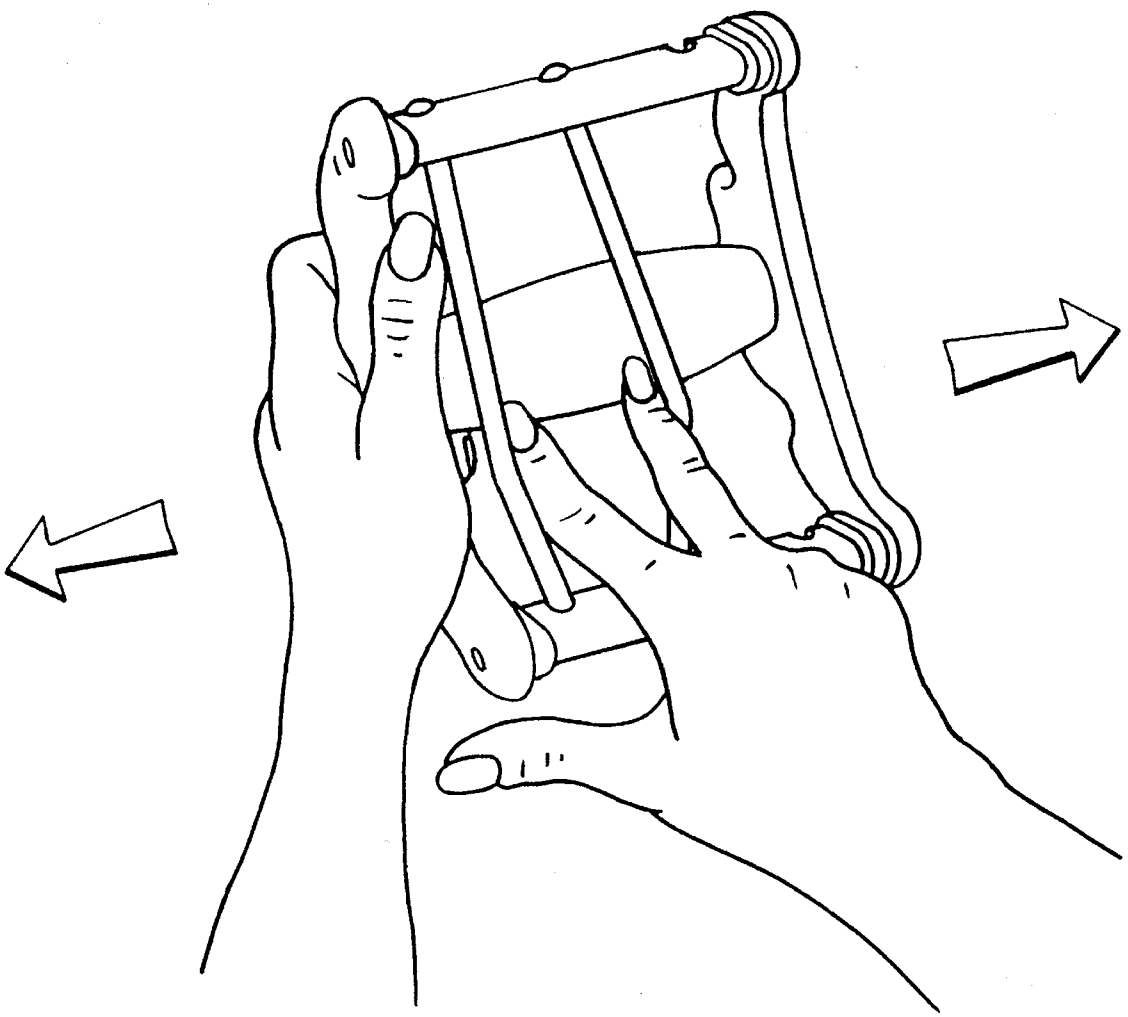
FIG. 25 is a perspective view showing use of the present invention for strengthening the abduction capabilities of the fingers.
Figure 26:
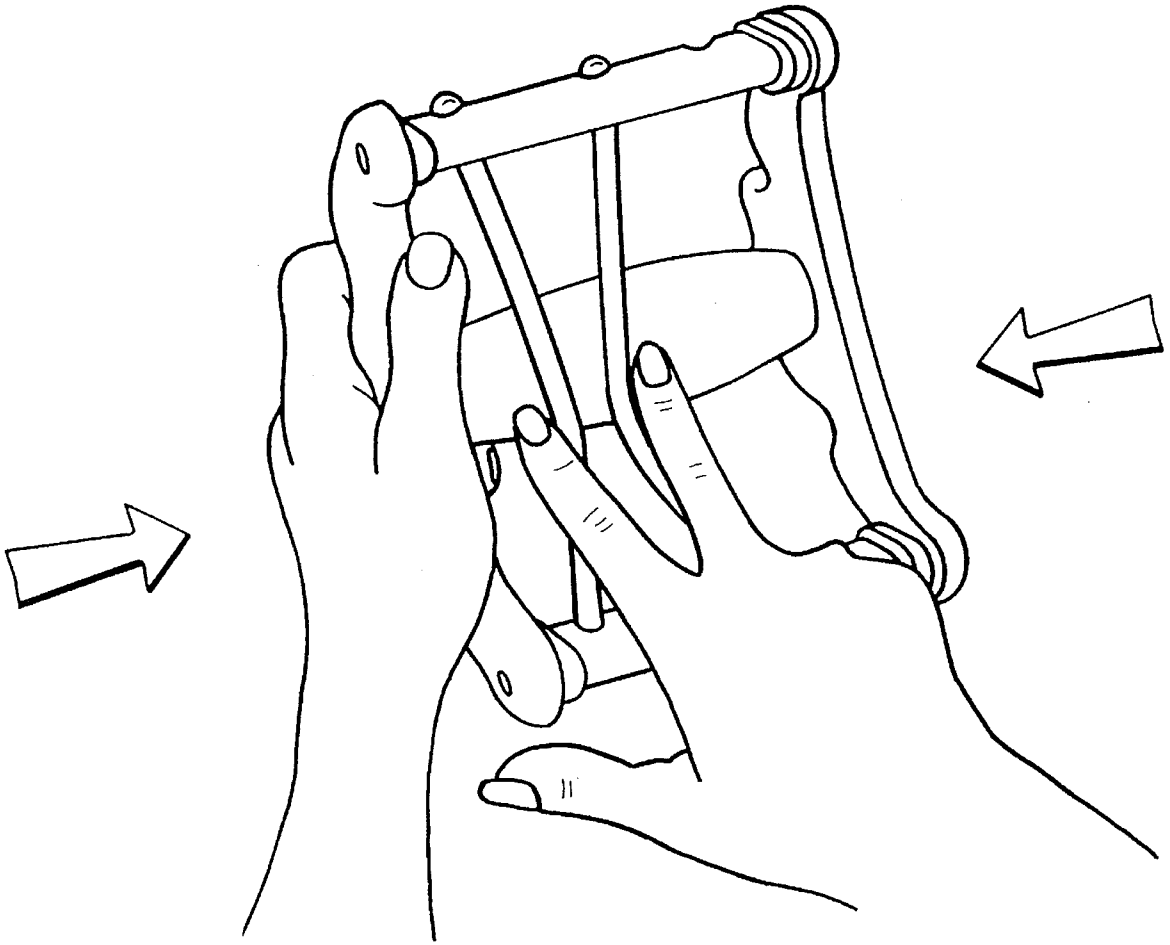
FIG. 26 is a perspective view showing use of the present invention for strengthening the adduction capabilities of the fingers and hand.

For strengthening the abduction capability of the fingers, the user should hold the device in one hand by the grip 20 or by one of the body members as shown in FIG. 25, and place two or more fingers from the other hand between adjacent bands, pointing towards the grip 20. By spreading the fingers apart in a scissor-like movement, the abduction capability of the fingers is strengthened. To strengthen the adduction capability of the fingers and hand, the user holds the device in the same position, but places the fingers on the outside of an adjacent pair of tension bands, as shown in FIG. 26, so the fingers "straddle" the two bands. The scissor-like movement is then performed by squeezing the fingers together, strengthening the adduction capability of the fingers and hand.

Figure 27:
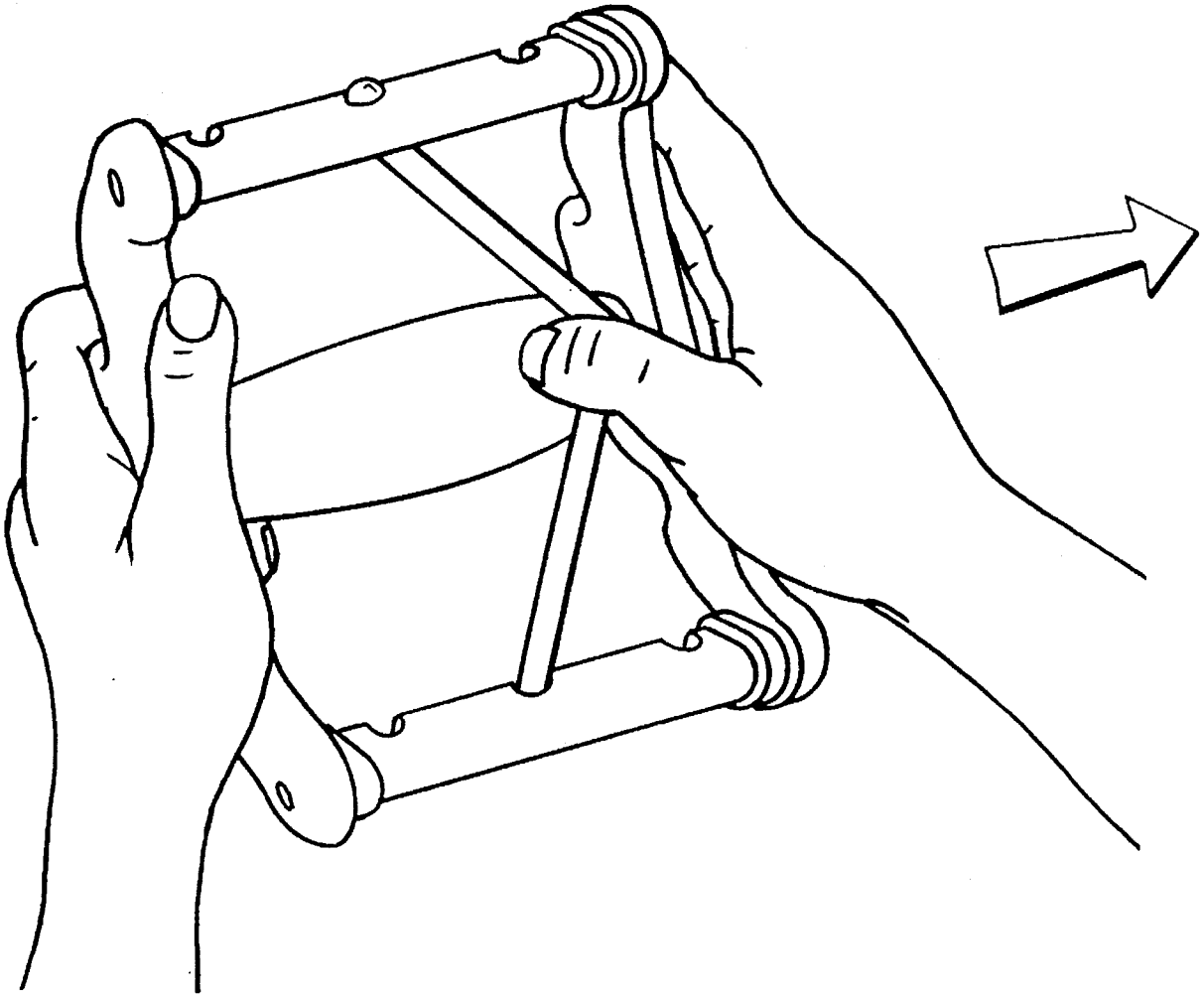
FIG. 27 is a perspective view showing use of the present invention for thumb abduction.
Figure 28:
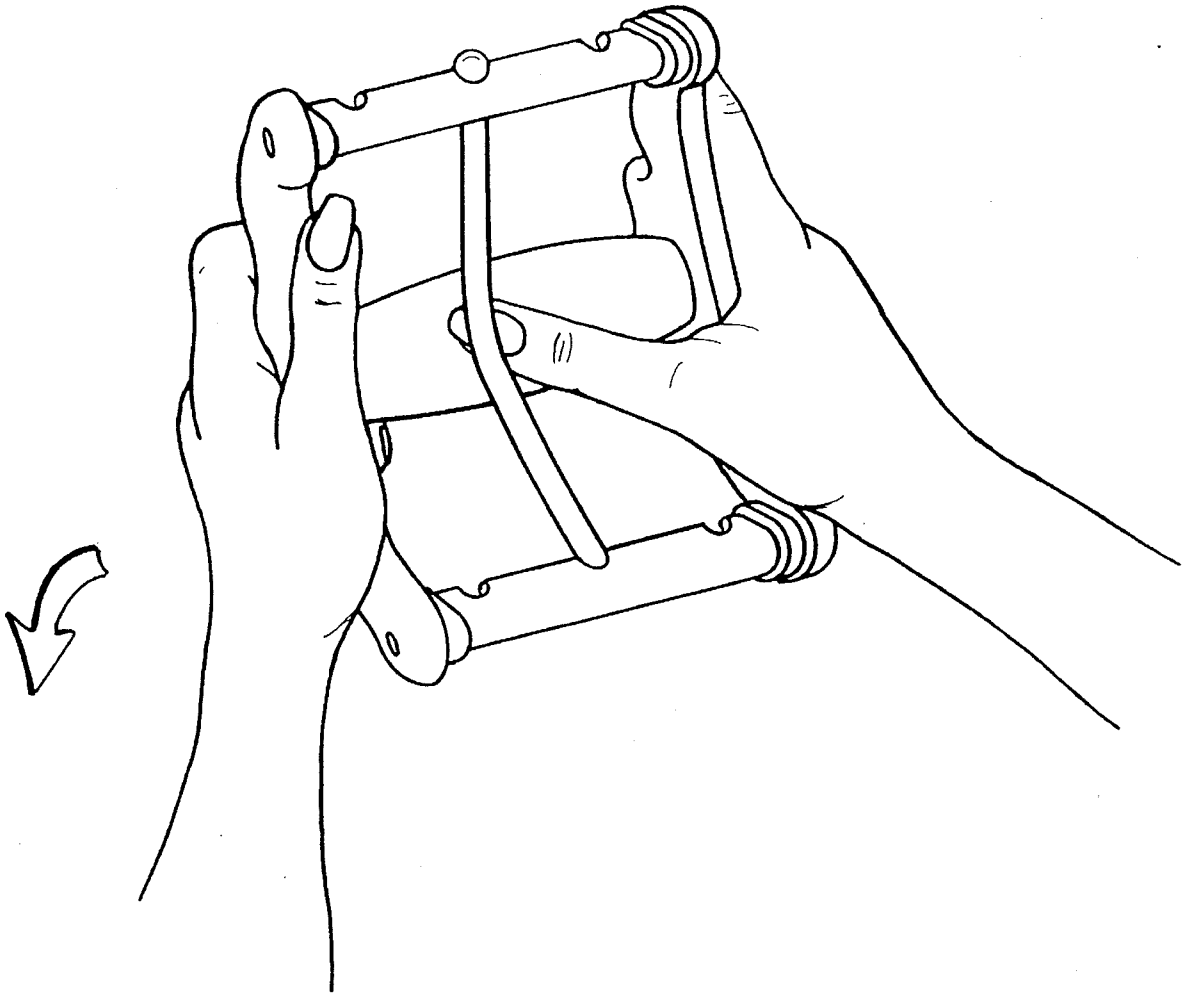
FIG. 28 is a perspective view showing use of the present invention for thumb adduction.

For thumb abduction, the device is held with the pinky, ring finger and index finger placed, one each, in the thumb slots, and the thumb hooks one of the bands as shown in FIG. 27. The user then squeezes the band with the thumb towards the palm, holds it for a predetermined period of time (e.g., a count of five) and then releases. This is repeated for a predetermined number of repetitions. For thumb adduction, the device is held in the same manner, except that the thumb is placed so that it rests against the "inside" (the side nearest the palm of the hand holding the device) of the desired tension band as shown in FIG. 28. The user then pushes the band away from the palm and holds it for a predetermined period of time, and repeats.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described and, accordingly, all suitable modifications and equivalents may be resorted to, falling within the scope of the invention.

What is claimed:

1. An exercise system comprising a plurality of components assembleable into a plurality of configurations on which a person can perform a variety of exercises to strengthen the forearm, elbow, wrist, hand, fingers and thumb, the exercise system comprising:

a main body comprising:

first and second body members, each having an inside surface, an outside surface, and first and second arms extending upwardly from a base portion;

first and second cross members, each having two ends and a horizontal length, said first cross member being coupled between said first arms and said second cross member being coupled between said second arms; and a grip coupled between said base portion of said first body member and said base portion of said second body member;

rocker means, attachable to the bottom of said body members, to form a curved surface enabling said main body to be rocked back and forth; and first and second handles, said first handle being removeably attached to the outer side of said first body member and said second handle being removeably attached to the outer edge of said second body member.

2. An exercise system as set forth in claim 1, wherein said base portion includes a plurality of indentations to accommodate fingers and/or thumbs during use of the device so that, when said rocker means is detached from said base portion, said indentations are accessible to the fingers and/or thumbs of the user of the device.

3. An exercise system as set forth in claim 1, further comprising a plurality of tension bands and wherein said first and second cross members each include a plurality of slots, the positioning of said slots on said first cross member corresponding to the positioning of said slots on said second cross member so that each of said tension bands can be connected between a slot on said first cross member and the corresponding slot on said second cross member, thereby providing an additional means for exercise.

4. An exercise system as set forth in claim 3, wherein said tension bands are of varying tensions so that a user of the exercise system can vary the tension of the tension bands being used.

5. An exercise system as set forth in claim 1, further comprising weight wrap means, attachable around said first or said second cross member, for adding additional weight to the exercise system.

* * * * *